US008061792B2

(12) United States Patent
Ito et al.

(10) Patent No.: US 8,061,792 B2
(45) Date of Patent: Nov. 22, 2011

(54) PRINTING APPARATUS, METHOD AND PROGRAM FOR INNER PERIPHERAL PRINTING OF ROTATABLY DRIVEN MEDIA

(75) Inventors: Tatsumi Ito, Kanagawa (JP); Yuichiro Ikemoto, Kanagawa (JP); Takeshi Matsui, Tokyo (JP); Koji Ashizaki, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/396,812

(22) Filed: Mar. 3, 2009

(65) Prior Publication Data

US 2009/0251500 A1 Oct. 8, 2009

(30) Foreign Application Priority Data

Apr. 4, 2008 (JP) ..... 2008-098338

(51) Int. Cl.
*B41J 3/00* (2006.01)
*B41J 2/15* (2006.01)

(52) U.S. Cl. ..... 347/2; 347/41

(58) Field of Classification Search ..... 347/2, 41
See application file for complete search history.

(56) References Cited

U.S. PATENT DOCUMENTS

| | | | | |
|---|---|---|---|---|
| 6,386,667 | B1 * | 5/2002 | Cariffe | 347/2 |
| 7,284,804 | B2 * | 10/2007 | Jones et al. | 347/2 |
| 7,399,044 | B2 * | 7/2008 | Masuyama et al. | 347/12 |
| 2008/0018680 | A1 | 1/2008 | Ito et al. | |

FOREIGN PATENT DOCUMENTS

| | | |
|---|---|---|
| JP | 2003-19828 | 1/2003 |
| JP | 2006-27193 | 2/2006 |
| JP | 2007-141321 | 6/2007 |
| JP | 2007-280527 | 10/2007 |
| JP | 2008-27535 | 2/2008 |

OTHER PUBLICATIONS

U.S. Appl. No. 12/474,842, filed May 29, 2009, Ito, et al.
U.S. Appl. No. 12/404,758, filed Mar. 16, 2009, Ito, et al.

* cited by examiner

*Primary Examiner* — Shelby Fidler
(74) *Attorney, Agent, or Firm* — Oblon, Spivak, McClelland, Maier & Neustadt, L.L.P.

(57) ABSTRACT

A printing apparatus includes a printing unit for printing visual information on a non-recording surface of a rotatably driven recording medium by discharging ink droplets. A control unit controls movement of the printing unit in a radial direction of the recording medium, and discharge timing of the ink droplets. The printing unit prints the visual information by multi-path printing by printing on a same radius position of the non-recording surface by discharging ink from different ink discharge nozzles. The control unit controls the printing unit so as to print with a first printing pattern having a first number of paths and a second printing pattern having a second number of paths. The first printing pattern is used on other locations of the non-recording surface and the second printing pattern is used when printing on an innermost periphery region of the non-recording surface.

7 Claims, 20 Drawing Sheets

ROTATIONAL DISCHARGE TIMING
NOZZLE No.
RADIAL ABSOLUTE POSITION
110

NOZZLE No.
110

NOZZLE No.
110

NOZZLE No.
110

NOZZLE No.
4 PATHS OF 5,6,7,8
4 PATHS OF 6,7,8,9
4 PATHS OF 7,8,9
4 PATHS OF 8,9
OVERHANG
110

FIG.8A

ROTATIONAL DISCHARGE TIMING

RADIAL ABSOLUTE POSITION

| | 0 | 1 | 2 | 3 | 4 | 5 | 6 | 7 | 8 | 9 | 10 | 11 |
|---|---|---|---|---|---|---|---|---|---|---|---|---|
| 8 | 1 | 1 | 1 | 1 | 1 | 1 | 1 | 1 | 1 | 1 | 1 | 1 |
| 9 | 1 | 1 | 1 | 1 | 1 | 1 | 1 | 1 | 1 | 1 | 1 | 1 |
| 10 | 1 | 1 | 1 | 1 | 1 | 1 | 1 | 1 | 1 | 1 | 1 | 1 |
| 11 | 1 | 1 | 1 | 1 | 1 | 1 | 1 | 1 | 1 | 1 | 1 | 1 |
| 12 | 1 | 1 | 1 | 1 | 1 | 1 | 1 | 1 | 1 | 1 | 1 | 1 |
| 13 | 1 | 1 | 1 | 1 | 1 | 1 | 1 | 1 | 1 | 1 | 1 | 1 |
| 14 | 1 | 1 | 1 | 1 | 1 | 1 | 1 | 1 | 1 | 1 | 1 | 1 |
| 15 | 1 | 1 | 1 | 1 | 1 | 1 | 1 | 1 | 1 | 1 | 1 | 1 |

FIG.8B

ROTATIONAL DISCHARGE TIMING

NOZZLE No.

| | 0 | 1 | 2 | 3 | 4 | 5 | 6 | 7 | 8 | 9 | 10 | 11 |
|---|---|---|---|---|---|---|---|---|---|---|---|---|
| 0 | 0 | 1 | 0 | 0 | 0 | 1 | 0 | 0 | 0 | 1 | 0 | 0 |
| 1 | 0 | 0 | 1 | 0 | 0 | 0 | 1 | 0 | 0 | 0 | 1 | 0 |
| 2 | 0 | 0 | 0 | 1 | 0 | 0 | 0 | 1 | 0 | 0 | 0 | 1 |
| 3 | 1 | 0 | 0 | 0 | 1 | 0 | 0 | 0 | 1 | 0 | 0 | 0 |
| 4 | 0 | 1 | 0 | 1 | 0 | 1 | 0 | 1 | 0 | 1 | 0 | 1 |
| 5 | 1 | 0 | 1 | 0 | 1 | 0 | 1 | 0 | 1 | 0 | 1 | 0 |
| 6 | 0 | 1 | 0 | 1 | 0 | 1 | 0 | 1 | 0 | 1 | 0 | 1 |
| 7 | 1 | 0 | 1 | 0 | 1 | 0 | 1 | 0 | 1 | 0 | 1 | 0 |

FIG.8C

ROTATIONAL DISCHARGE TIMING

NOZZLE No.

| | 0 | 1 | 2 | 3 | 4 | 5 | 6 | 7 | 8 | 9 | 10 | 11 |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 |
| 2 | 0 | 0 | 1 | 0 | 0 | 0 | 1 | 0 | 0 | 0 | 1 | 0 |
| 3 | 0 | 0 | 0 | 1 | 0 | 0 | 0 | 1 | 0 | 0 | 0 | 1 |
| 4 | 1 | 0 | 0 | 0 | 1 | 0 | 0 | 0 | 1 | 0 | 0 | 0 |
| 5 | 0 | 1 | 0 | 0 | 0 | 1 | 0 | 0 | 0 | 1 | 0 | 0 |
| 6 | 1 | 0 | 1 | 0 | 1 | 0 | 1 | 0 | 1 | 0 | 1 | 0 |
| 7 | 0 | 1 | 0 | 1 | 0 | 1 | 0 | 1 | 0 | 1 | 0 | 1 |

ROTATIONAL DISCHARGE TIMING
0 1 2 3 4 5 6 7 8 9 10...
RADIAL ABSOLUTE POSITION
8
9
10
11
12
13
14
15
INNERMOST PERIPHERY

NOZZLE No.
ROTATIONAL DISCHARGE TIMING
0 1 2 3 4 5 6 7 8 9 10...

NOZZLE No.
ROTATIONAL DISCHARGE TIMING
0 1 2 3 4 5 6 7 8 9 10...
OVERHANG

FIG.11A

ROTATIONAL DISCHARGE TIMING

RADIAL ABSOLUTE POSITION

| | 0 | 1 | 2 | 3 | 4 | 5 | 6 | 7 | 8 | 9 | 10 |
|---|---|---|---|---|---|---|---|---|---|---|---|
| 8 | 1 | 1 | 1 | 1 | 1 | 1 | 1 | 1 | 1 | 1 | 1 |
| 9 | 1 | 1 | 1 | 1 | 1 | 1 | 1 | 1 | 1 | 1 | 1 |
| 10 | 1 | 1 | 1 | 1 | 1 | 1 | 1 | 1 | 1 | 1 | 1 |
| 11 | 1 | 1 | 1 | 1 | 1 | 1 | 1 | 1 | 1 | 1 | 1 |
| 12 | 1 | 1 | 1 | 1 | 1 | 1 | 1 | 1 | 1 | 1 | 1 |
| 13 | 1 | 1 | 1 | 1 | 1 | 1 | 1 | 1 | 1 | 1 | 1 |
| 14 | 1 | 1 | 1 | 1 | 1 | 1 | 1 | 1 | 1 | 1 | 1 |
| 15 | 1 | 1 | 1 | 1 | 1 | 1 | 1 | 1 | 1 | 1 | 1 |

FIG.11B

ROTATIONAL DISCHARGE TIMING

NOZZLE No.

| | 0 | 1 | 2 | 3 | 4 | 5 | 6 | 7 | 8 | 9 | 10 |
|---|---|---|---|---|---|---|---|---|---|---|---|
| 0 | 0 | 1 | 0 | 1 | 0 | 1 | 0 | 1 | 0 | 1 | 0 |
| 1 | 1 | 0 | 1 | 0 | 1 | 0 | 1 | 0 | 1 | 0 | 1 |
| 2 | 0 | 1 | 0 | 1 | 0 | 1 | 0 | 1 | 0 | 1 | 0 |
| 3 | 1 | 0 | 1 | 0 | 1 | 0 | 1 | 0 | 1 | 0 | 1 |
| 4 | 0 | 1 | 0 | 1 | 0 | 1 | 0 | 1 | 0 | 1 | 0 |
| 5 | 1 | 0 | 1 | 0 | 1 | 0 | 1 | 0 | 1 | 0 | 1 |
| 6 | 0 | 1 | 0 | 1 | 0 | 1 | 0 | 1 | 0 | 1 | 0 |
| 7 | 1 | 0 | 1 | 0 | 1 | 0 | 1 | 0 | 1 | 0 | 1 |

FIG.11C

ROTATIONAL DISCHARGE TIMING

NOZZLE No.

| | 0 | 1 | 2 | 3 | 4 | 5 | 6 | 7 | 8 | 9 | 10 |
|---|---|---|---|---|---|---|---|---|---|---|---|
| 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 |
| 2 | 1 | 0 | 1 | 0 | 1 | 0 | 1 | 0 | 1 | 0 | 1 |
| 3 | 0 | 1 | 0 | 1 | 0 | 1 | 0 | 1 | 0 | 1 | 0 |
| 4 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 |

FIG.13

ROTATIONAL DISCHARGE TIMING

| NOZZLE No. | 0 | 1 | 2 | 3 | 4 | 5 | 6 | 7 | 8 | 9 | 10 |
|---|---|---|---|---|---|---|---|---|---|---|---|
| 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 |
| 2 | 1 | 0 | 1 | 0 | 1 | 0 | 1 | 0 | 1 | 0 | 1 |
| 3 | 0 | 1 | 0 | 1 | 0 | 1 | 0 | 1 | 0 | 1 | 0 |
| 4 | 1 | 1 | 1 | 1 | 1 | 1 | 1 | 1 | 1 | 1 | 1 |
| 5 | 1 | 1 | 1 | 1 | 1 | 1 | 1 | 1 | 1 | 1 | 1 |
| 6 | 1 | 1 | 1 | 1 | 1 | 1 | 1 | 1 | 1 | 1 | 1 |
| 7 | 1 | 1 | 1 | 1 | 1 | 1 | 1 | 1 | 1 | 1 | 1 |

BACKGROUND ART

PRINTING APPARATUS, METHOD AND PROGRAM FOR INNER PERIPHERAL PRINTING OF ROTATABLY DRIVEN MEDIA

BACKGROUND OF THE INVENTION

1. Field of the Invention

The present invention relates to printing apparatuses, printing methods, and computer programs, and more specifically, to a printing apparatus for printing on a non-recording surface of a recording medium that is detachably attached and rotatably driven, a printing method, and a computer program.

2. Description of the Related Art

A printing apparatus for printing information by dropping ink droplets from an ink droplet discharge nozzle for discharging ink droplets with respect to a non-recording surface of a disc-shaped recording medium such as CD, DVD, and Blu-ray disc (trademark) is known. A method of printing on the non-recording surface of the recording medium includes a method of moving the ink droplet discharge nozzle from the peripheral edge part towards the central part of the recording medium in a radial direction of the recording medium while rotating the recording medium, and dropping ink droplets onto the non-recording surface of the recording medium. An example of a printing apparatus for printing by such printing method is described in, for example, Japanese Patent Application Laid-Open No. 2008-27535.

Multi-path printing is one example of a method of printing on a non-recording surface of a recording medium. The multi-path printing completes printing of visual information by discharging ink from different ink droplet discharge nozzles to the same radius position of the non-recording surface. Through printing by discharging ink from different ink droplet discharge nozzles to the same radius position of the non-recording surface, even if a certain ink droplet discharge nozzle is not able to discharge the ink droplets due to reasons such as clogging of ink, printing can be carried out by discharging ink from another ink droplet discharge nozzle so that the radius position that is not discharged with ink does not exist, which improves the printing quality (see e.g., Japanese Patent Application Laid-Open No. 2008-27535).

SUMMARY OF THE INVENTION

However, an inkjet head arranged with the ink droplet discharge nozzles on the inner side than a printable region of the non-recording surface of the recording medium is to be moved when performing the multi-path printing. Therefore, the inkjet head may interfere with a chucking portion depending on the printing pattern of the multi-path printing.

The present invention addresses the above-identified, and other issues associated with conventional methods and apparatuses, and it is desirable to provide a new and improved printing apparatus capable of performing printing such that the inkjet head and the chucking portion do not interfere when performing the multi-path printing on the non-recording surface of the rotatably driven recording medium, a printing method, and a computer program.

According to an embodiment of the present invention, there is provided a printing apparatus including a printing unit for printing visual information on a non-recording surface of a recording medium, which is detachably attached and rotatably driven, by discharging ink droplets; and a control unit for controlling movement of the printing unit in a radial direction of the rotatably driven recording medium, and controlling a discharge timing of the ink droplets discharged from the printing unit, wherein the printing unit includes a plurality of ink droplet discharge nozzles, and prints the visual information by multi-path printing of completing printing on a same radius position of the non-recording surface by discharging ink from different ink discharge nozzles, and the control unit controls the printing unit so as to print with a printing pattern different from a printing pattern on other locations of the non-recording surface when printing on an innermost periphery region smaller than a length of a plurality of ink droplet discharge nozzles at an inner peripheral part of a printable region of the non-recording surface with the printing unit.

According to such configuration, printing unit prints the visual information on the non-recording surface of the recording medium, which is detachably attached and rotatably driven, by discharging ink droplets, and the control unit controls the movement of the printing unit in the radial direction of the rotatably driven recording medium and controls the discharge timing of the ink droplets discharged from the printing unit. The printing unit includes a plurality of ink droplet discharge nozzles, and prints the visual information by multi-path printing of completing the printing on the same radius position of the non-recording surface by discharging ink from different ink discharge nozzles, and the control unit controls the printing unit so as to print with a printing pattern different from a printing pattern on other locations of the non-recording surface when printing on the innermost peripheral region smaller than the length of the plurality of ink droplet discharge nozzles at the inner peripheral part of the printable region of the non-recording surface with the printing unit. As a result, when printing on the innermost peripheral region smaller than the length of the plurality of ink droplet discharge nozzles at the inner peripheral part of the printable region of the non-recording surface of the rotatably driven recording medium, printing can be performed with the printing pattern different from the printing pattern on other locations of the non-recording surface so that printing can be performed without the inkjet head interfering with the chucking portion.

The control unit may control the printing unit so as to print with number of paths of the multi-path printing reduced compared to other locations of the non-recording surface when multi-path printing the innermost peripheral region of the non-recording surface.

The control unit may control the printing unit so that a movement amount of the printing unit is smaller than a movement amount of other locations when multi-path printing the innermost peripheral region of the non-recording surface.

The control unit may control the printing unit so as to print on the same radius position of the non-recording surface by discharging ink from the same ink discharge nozzle with respect to the innermost peripheral region of the non-recording surface.

According to another embodiment of the present invention, there is provided a printing method including the steps of: generating printing data of visual information to print on a non-recording surface of a recording medium, which is detachably attached and rotatably driven; printing the visual information by multi-path printing of completing printing on a same radius position of the non-recording surface by discharging ink from different ink discharge nozzles by a printing unit including a plurality of ink droplet discharge nozzles; and controlling the printing unit to print with a printing pattern different from a printing pattern on other locations of the non-recording surface when printing on an innermost peripheral region smaller than a length of the plurality of ink droplet discharge nozzles at an inner peripheral part of a printable region of the non-recording surface with the printing unit.

According to another embodiment of the present invention, there is provided a computer program for causing a computer to execute the steps of: generating printing data of visual information to print on a non-recording surface of a recording medium, which is detachably attached and rotatably driven; printing the visual information by multi-path printing of completing printing on a same radius position of the non-recording surface by discharging ink from different ink discharge nozzles by a printing unit including a plurality of ink droplet discharge nozzles; and controlling the printing unit to print with a printing pattern different from a printing pattern on other locations of the non-recording surface when printing on an innermost peripheral region smaller than a length of the plurality of ink droplet discharge nozzles at an inner peripheral part of a printable region of the non-recording surface with the printing unit.

As described above, according to the present invention, a new and improved printing apparatus capable of printing so that the inkjet head does not interfere with the chucking portion by performing printing with the printing pattern different from the printing pattern on other locations of the non-recording surface when printing the innermost peripheral region smaller than the length of the plurality of ink droplet discharge nozzles at the inner peripheral part of the printable region of the non-recording surface of the rotatably driven recording medium, a printing method, and a computer program can be provided.

BRIEF DESCRIPTION OF THE DRAWINGS

FIG. 8A is an explanatory diagram showing ink discharge data for realizing the printing pattern shown in FIGS. 7A to 7E;

FIG. 8B is an explanatory diagram showing the ink discharge data for realizing the printing pattern shown in FIGS. 7A to 7E;

FIG. 8C is an explanatory diagram showing the ink discharge data for realizing the printing pattern shown in FIGS. 7A to 7E;

FIG. 11A is an explanatory view showing ink discharge data in time of the multi-path printing by two-paths of the related art;

FIG. 11B is an explanatory view showing the ink discharge data in time of the multi-path printing by two-paths of the related art;

FIG. 11C is an explanatory view showing the ink discharge data in time of the multi-path printing by two-paths of the related art;

FIG. 13 is an explanatory diagram showing ink discharge data for realizing the printing pattern shown in FIGS. 12A and 12B;

DETAILED DESCRIPTION OF THE PREFERRED EMBODIMENTS

Figure 1:
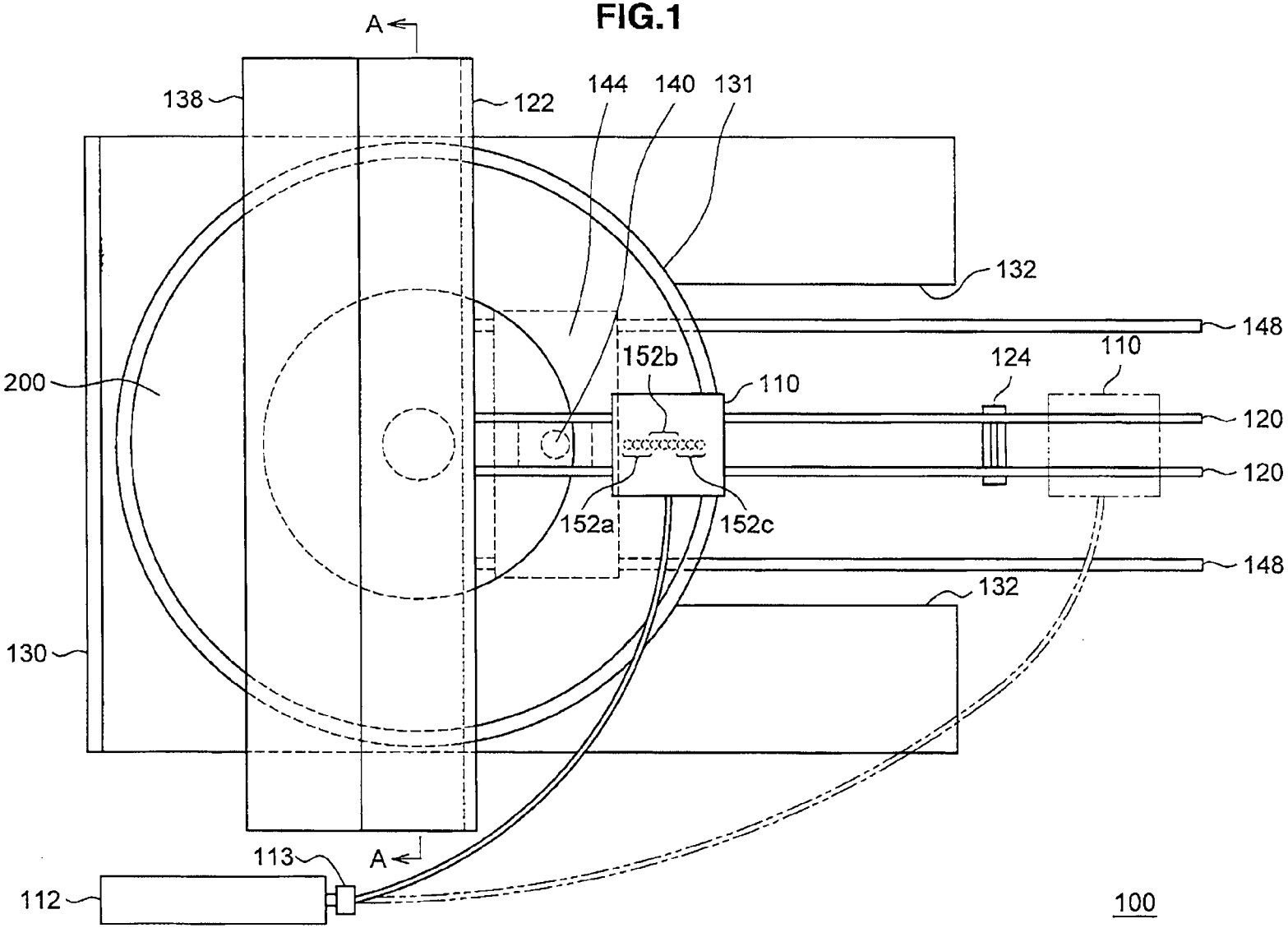
FIG. 1 is an explanatory view showing a configuration of an optical disc device 100 according to one embodiment of the present invention from an upper surface.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Figure 2:
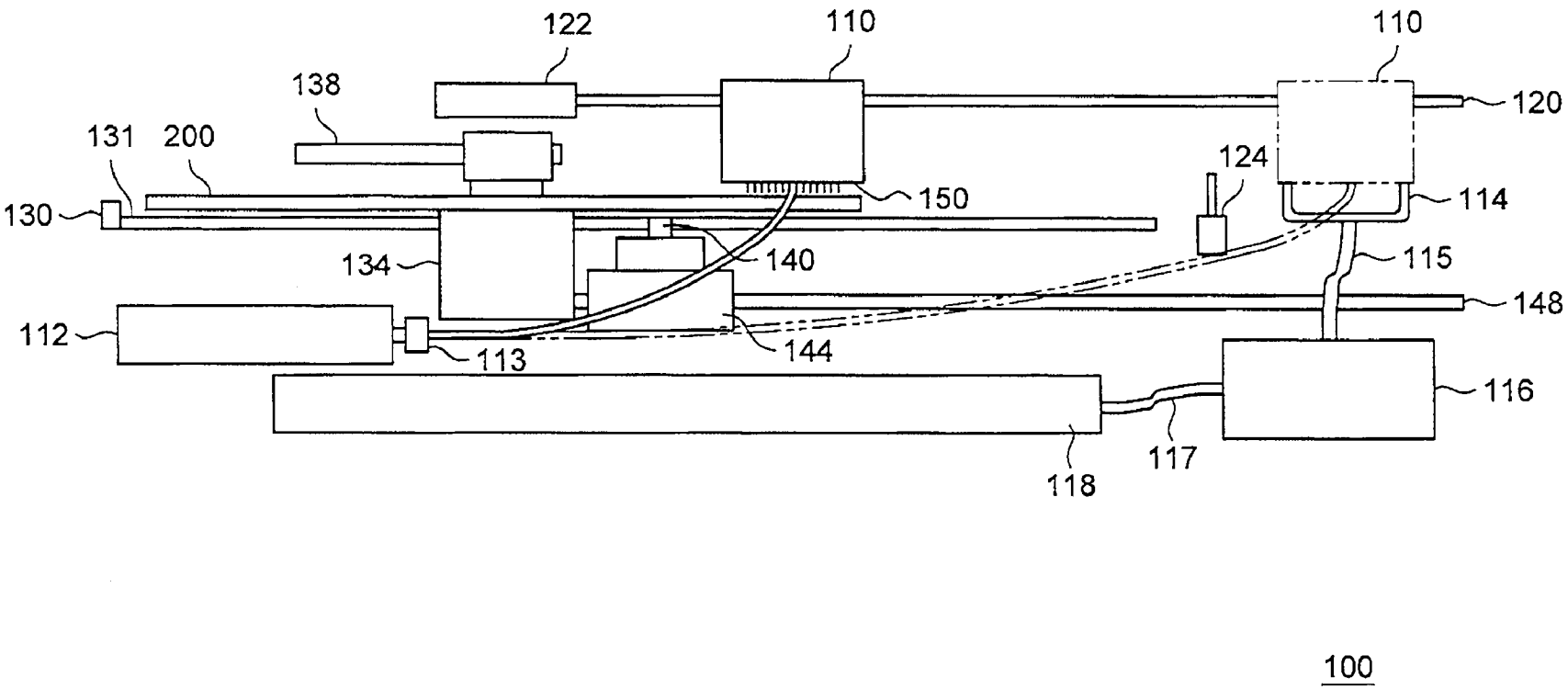
FIG. 2 is an explanatory view showing the configuration of the optical disc device 100 according to one embodiment of the present invention from a side surface.

First, a configuration of an optical disc device 100 according to one embodiment of the present invention will be described. FIG. 1 is an explanatory view showing the configuration of an optical disc device 100 according to one embodiment of the present invention from an upper surface. FIG. 2 is an explanatory view showing the configuration of the optical disc device 100 according to one embodiment of the present invention from a side surface. The configuration of the optical disc device 100 according to one embodiment of the present invention will be described using FIGS. 1 and 2.

The optical disc device 100 is one example of a printing apparatus of the embodiment of the present invention. The optical disc device 100 is configured to include a recording/reproducing unit for recording a data signal to a recording surface of an optical disc 200, serving as a recording medium of the embodiment of the present invention, and/or reproducing a data signal from the recording surface of the optical disc 200; and a printing unit for printing visual information such as characters and images on a non-recording surface (label surface) of the optical disc 200.

The printing unit is configured to include an inkjet head 110, an ink cartridge 112, a head cap 114, a suction pump 116, a discard ink absorbing body 118, a first guide shaft 120, a shaft support portion 122, and a blade 124.

The inkjet head 110 includes a plurality of ink droplet discharge nozzles 152 for discharging ink droplets onto a nozzle surface 150 facing the non-recording surface of the optical disc 200. The ink droplet discharge nozzles 152 discharges ink droplets at a predetermined ink discharge frequency through the inkjet method. The ink droplet discharge nozzles 152 include a cyan discharge nozzle 152*a*, a magenta discharge nozzle 152*b*, and a yellow discharge nozzle 152*c*, and are arrayed in a line in the radius direction of the optical disc 200. The inkjet method is a method of discharging ink as microscopic liquid droplet from the ink droplet discharge nozzles 152 and attaching the ink to a printing material.

The inkjet head 110 is positioned on the outer side of the optical disc 200 in time of print waiting, and arranged on the upper side of the optical disc 200 in time of printing. Furthermore, the inkjet head 110 may have a function of dummy discharging the ink from the ink droplet discharge nozzles 152 before and after the printing in order to discharge thick ink, air bubbles, foreign substances, and the like of the ink droplet discharge nozzles 152.

The ink cartridge 112 accommodates ink of a predetermined color, and supplies ink to the inkjet head 110. More specifically, the ink cartridge 112 is a container made from tubular resin. A porous body (e.g., sponge, ceramics, or the like) is incorporated inside the container, and ink is stored by the capillary force of the porous body.

The ink cartridge 112 supplies ink to the inkjet head 110 through a coupling portion 113. The ink cartridge 112 is configured to be detachably attached to the coupling portion 113 so as to be easily changed when the ink runs out.

The head cap 114 is attached to the nozzle surface 150 of the inkjet head 110 in time of print waiting of waiting for the printing on the non-recording surface of the optical disc 200. The head cap 114 has a role of preventing drying of ink contained in the inkjet head 110, and attachment of foreign substances such as dust and dirt to the nozzle surface 150. When the printing on the non-recording surface of the optical disc 200 is started, the head cap 114 is separated from the nozzle surface 150. The head cap 114 may include a porous body for adsorbing ink dummy discharged from the inkjet head 110. In dummy discharging from the inkjet head 110, a valve mechanism for adjusting the internal space of the head cap 114 to an atmospheric pressure may be arranged.

The suction pump 116 is connected to the head cap 114 by way of a tube 115. According to such configuration, the suction pump 116 can suction the ink inside the inkjet head 110 by applying negative pressure to the space inside the head cap 114 when the head cap 114 is attached to the inkjet head 110. The suction pump 116 may also suction the ink dummy discharged and adsorbed by the ink head cap 114.

The discard ink absorbing body 118 is connected to the suction pump 116 by way of a tube 117. According to such configuration, the ink suctioned by the suction pump 116 can be discarded.

The first guide shaft 120 moves the inkjet head 110 in the radial direction of the optical disc 200. The movement of the inkjet head 110 may be performed by a ball screw feeding mechanism of the first guide shaft 120, or may be performed by a rack-opinion mechanism, a belt feeding mechanism, a wire feeding mechanism, or the like. The shaft support portion 122 supports one end of the first guide shaft 120.

The blade 124 is arranged between a print waiting position (position in time of print waiting) and the print position of the inkjet head 110. When the inkjet head 110 moves from the print waiting position to the print position, or when the inkjet head 110 moves from the print position to the print waiting position, the nozzle surface 150 is brushed away to the inkjet head 110 to remove ink, foreign substances, or the like attached to the nozzle surface 150. The blade 124 may be configured to move up and down, or the blade 124 may be moved up and down to choose whether or not to brush away the nozzle surface 150.

The recording/reproducing unit is configured to include a tray 130, a spindle motor 134, a chucking portion 138, an optical pickup 140, a moving stand 144, and a second guide shaft 148.

The tray 130 is provided to mount the optical disc 200. The tray 130 is made from a plate-shaped member of rectangular shape in plane slightly larger than the optical disc 200, where a disc accommodating portion 131 including a circular recess for accommodating the optical disc 200 is formed on the upper surface.

The spindle motor 134 rotates based on a control signal input from a motor drive circuit (not shown) for driving the spindle motor 134. The spindle motor 134 functions as a driver for drive the optical disc 200 in cooperation with the motor drive circuit.

The tray 130 may be formed with a cutout 132 to avoid contact with the spindle motor 134, or the like. As shown in FIG. 1, the cutout 132 may be formed large from one short side of the tray 130 to the central part of the disc accommodating portion 131.

The chucking portion 138 contacts the upper part of the spindle motor 134. The optical disc 200 accommodated in the disc accommodating portion 131 rotates by the rotation of the spindle motor 134, and rises from the disc accommodating portion 131. The chucking portion 138 holds down from above the optical disc 200 rose from the disc accommodating portion 131. The separation of the optical disc 200 from the disc accommodating portion 131 is prevented by holding down the optical disc 200 with the chucking portion 138 from above.

The optical pickup 140 is an optical system module configured to include a photodetector, an objective lens, a biaxial actuator for facing the objective lens to the recording surface of the optical disc 200, and the like. The photodetector of the optical pickup 140 is configured by a semiconductor laser serving as a light source for emitting light beam, a light receiving element for receiving the light beam reflected by and returned from the recording surface of the optical disc 200, and the like. The optical pickup 140 emits the light beam from the semiconductor laser, collects the light beam by the objective lens, irradiates the recording surface of the optical disc 200 and receives the light beam reflected by the recording surface with the photodetector to write the information signal on the recording surface of the optical disc 200, and/or read the information signal from the recording surface of the optical disc 200.

The moving stand 144 is provided to mount the optical pickup 140, and is movable by the second guide shaft 148 in the radial direction of the optical disc 200. The second guide shaft 148 moves the moving stand 144 in the radial direction of the optical disc 200. The movement of the moving stand 144 may be performed by a ball screw feeding mechanism of the second guide shaft 148, or may be performed by a rack-opinion mechanism, a belt feeding mechanism, a wire feeding mechanism, or the like.

In FIG. 1, a configuration in which the inkjet head 110 is arranged with one line of ink droplet discharge nozzles 152 in the radial direction of the optical disc 200 has been illustrated, but the present invention is not limited thereto. In the embodiment of the present invention, the inkjet head may be arranged with plural lines of ink droplet discharge nozzles in the radial direction.

The configuration of the optical disc device 100 according to one embodiment of the present invention has been described using FIGS. 1 and 2. The configuration of the optical disc 200 will now be described.

Figure 3:
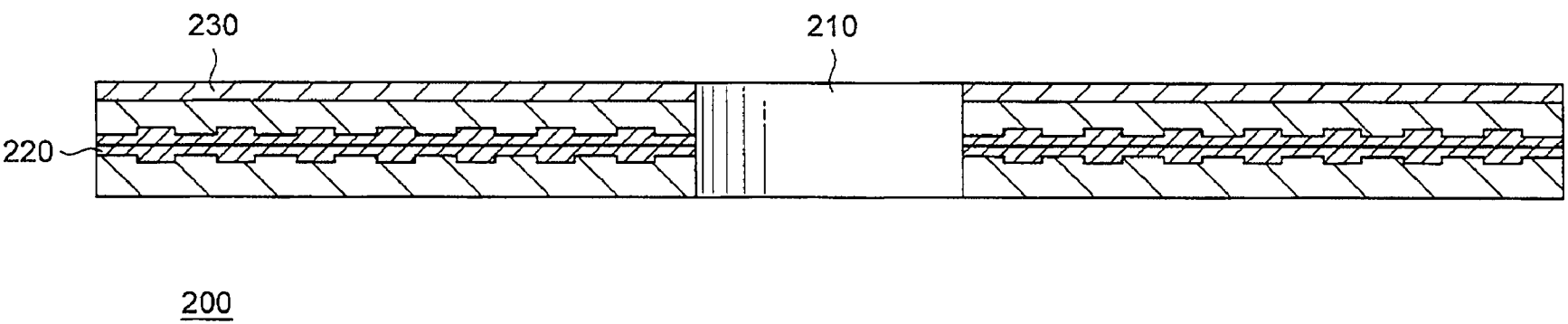
FIG. 3 is an explanatory view schematically showing the cross-section taken along line A-A of FIG. 1 of the optical disc 200.

FIG. 3 is an explanatory view schematically showing the cross-section taken along line A-A of FIG. 1 of the optical disc 200. The configuration of the optical disc 200 will be described below using FIG. 3.

As shown in FIG. 3, the optical disc 200 is configured to include a center hole 210, a recording surface 220, and a non-recording surface 230.

The center hole 210 is a circular hole formed at a central part of the optical disc 200 to allow the optical disc 200 to be fitted to the spindle motor 134 and the chucking portion 138. The diameter of the center hole 210 is desirably about 15 to 16 mm.

The recording surface 220 is configured to include a data signal recording region on which various information are recorded, and a reference signal recording region for detecting a rotational angle of the optical disc 200. For instance, in the case of the DVD-R, the data signal recording region is formed by a spiral-shaped land-groove structure. The configuration of the recording surface 220 of the optical disc 200 will be hereinafter described in detail.

The non-recording surface 230 functions as a reception layer (visual information printing layer) of the ink in inkjet printing, and is formed such that label information such as characters, symbols, and pictures can be printed. The printable range of the non-recording surface 230 may be a doughnut-shaped region having a radius of 20 to 57 mm and a width of about 37 mm of the optical disc 200. The non-recording surface 230 may be formed by attaching a paper to one surface of the optical disc 200.

In the present embodiment, the optical disc 200 is used as one example of the recording medium of the embodiment of the present invention, but the present invention is not limited to such example. The recording medium may be a magnetic disc, a magneto-optical disc, an electrically rewritable flash memory, or the like.

The configuration of the optical disc 200 has been described above using FIG. 3. The flow of control of the printing unit and the recording/reproducing unit in the optical disc device 100 according to one embodiment of the present invention will now be described.

Figure 4:
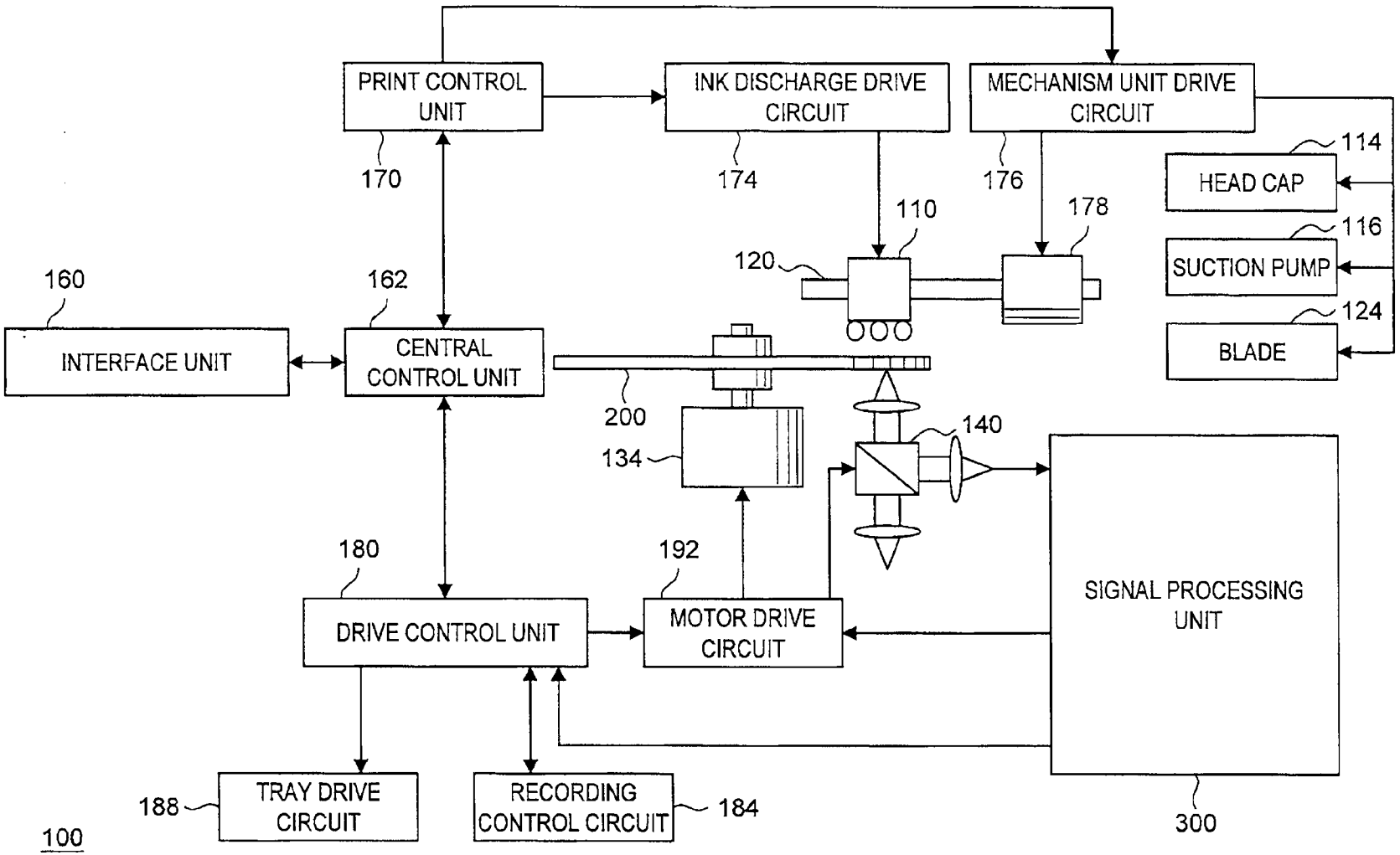
FIG. 4 is an explanatory view describing the function configuration of the optical disc device 100 according to one embodiment of the present invention.

FIG. 4 is an explanatory view describing the function configuration of the optical disc device 100 according to one embodiment of the present invention. The function configuration of the optical disc device 100 according to one embodiment of the present invention will now be described using FIG. 4.

As shown in FIG. 4, the optical disc device 100 according to one embodiment of the present invention is configured to include an interface unit 160, a central control unit 162, a print control unit 170, an ink discharge drive circuit 174, a mechanism drive circuit 176, a head drive motor 178, a drive control unit 180, a recording control circuit 184, a tray drive circuit 188, a motor drive circuit 192, and a signal processing unit 300.

The interface unit 160 is a connection unit enabling the optical disc device 100 and an external device (not shown) to communicate signals. The external device may be a personal computer, DVD recorder, Blu-ray disc (trademark) recorder, or the like. When the data signal to record on the recording surface 220 of the optical disc 200 and the visual information to print on the non-recording surface 230 are input from the external device, the interface unit 160 outputs the input signal and information to the central control unit 162. The interface unit 160 also outputs data signal read out from the recording surface 220 of the optical disc 200 by the optical disc device 100 to the external device.

The central control unit 162 performs the overall control of the optical disc device 100. Specifically, the central control unit 162 performs polar coordinate conversion on the visual information input from the interface unit 160 and outputs to the print control unit 170, or outputs the data signal input from the interface unit 160 to the drive control unit 180. The central control unit 162 also outputs a reference signal output from the drive control unit 180 to the print control unit 170.

The print control unit 170 outputs the signal for controlling the printing of the visual information to the ink discharge drive circuit 174 and the mechanism unit drive circuit 176, respectively based on the input of the polar coordinate converted visual information and the reference signal from the central control unit 162. The print control unit 170 generates ink discharge data based on the image data obtained by the image data signal provided from the central control unit 162. The generation of the ink discharge data will be hereinafter described in detail.

The ink discharge drive circuit 174 drives the inkjet head 110, and discharges ink droplets from the inkjet head 110 with respect to the non-recording surface of the optical disc 200. For instance, the ink discharge drive circuit 174 may be an electrode pair arranged in the inkjet head 110, where the ink droplets are discharged by creating a potential difference between the electrode pairs based on the signal input from the print control unit 170. That is, the electrode pair deforms when the potential difference is created between the electrode pairs, thereby compressing the ink tank holding the tank and discharging the ink droplets.

In FIG. 4, the ink discharged from the nozzle surface 150 of the inkjet head 110 is schematically shown in the form of water droplets. The present invention is not limited to such configuration, and ink may be discharged from the inkjet head 110 by generating heat.

The mechanism drive circuit 176 drives the head cap 114, the suction pump 116, the blade 124, and the head drive motor 178. The head drive motor 178 is a motor for rotating the first guide shaft 120 to move the inkjet head 110 in the radial direction of the optical disc 200.

The drive control unit 180 controls recordation of the data signal to the recording surface 220 of the optical disc 200, and reproduction of the data signal from the recording surface 220. The drive control unit 180 may also control the rotation speed of the optical disc 200 when recording the data signal on the optical disc 200 or reproducing the data signal from the optical disc 200.

The recording control circuit 184 performs encode processing, modulation processing, and the like of the data signal such as music signal and video signal. The tray drive circuit 188 drives the tray 130 to be mounted with the optical disc 200.

The motor drive circuit 192 drives the spindle motor 134 and the optical pickup drive motor (not shown) for driving the optical pickup 140 based on the control of the drive control unit 180. The spindle motor 134 rotates the optical disc 200 by the motor drive circuit 192, and the optical pickup drive motor moves the position in the radial direction of the optical pickup 140 by the motor drive circuit 192.

The signal processing unit 300 performs processes such as demodulation, error detection, and correction of the RF (Radio Frequency) signal input from the optical pickup 140 to reproduce the data signal or generate a tracking signal.

The function configuration of the optical disc device 100 according to one embodiment of the present invention has been described using FIG. 4. Next, the printing method using the optical disc device 100 according to one embodiment of the present invention will be described below, but issues of the related art will be described with reference to the drawings before describing the printing method.

Figure 14:
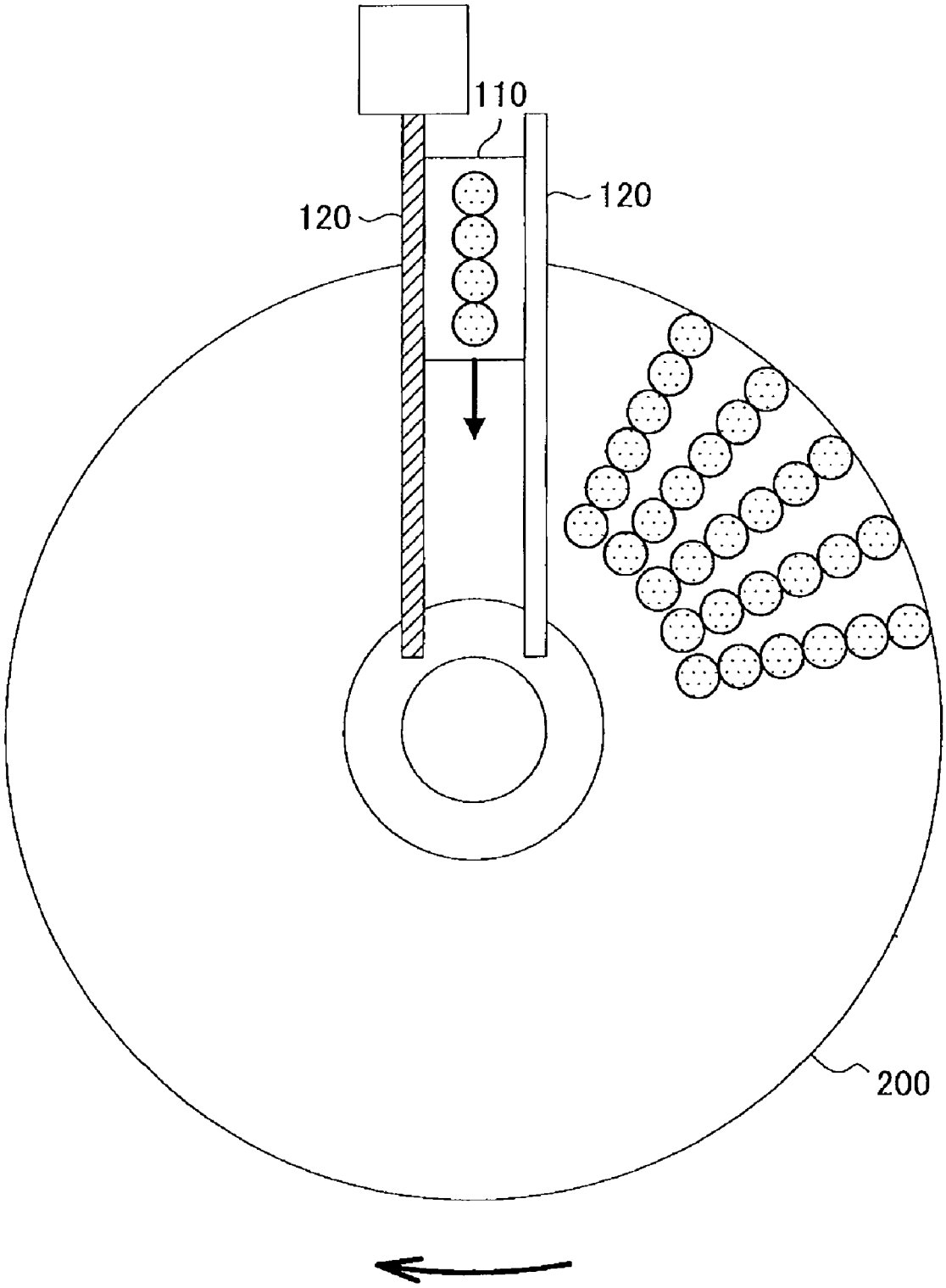
FIG. 14 is an explanatory view schematically showing printing using an inkjet head 110 with respect to a non-recording surface 230.

FIG. 14 is an explanatory view schematically showing printing on the non-recording surface 230 of the optical disc 200 using the inkjet head 110. Here, a case of printing the pattern as shown in FIG. 14 through multi-path printing by two-paths will be described. In FIG. 14, four ink droplet discharge nozzles of the inkjet head 110 are arranged in a line to facilitate the description, but the arrangement pattern of the ink droplet discharge nozzles is not limited to such example.

Figure 15A:
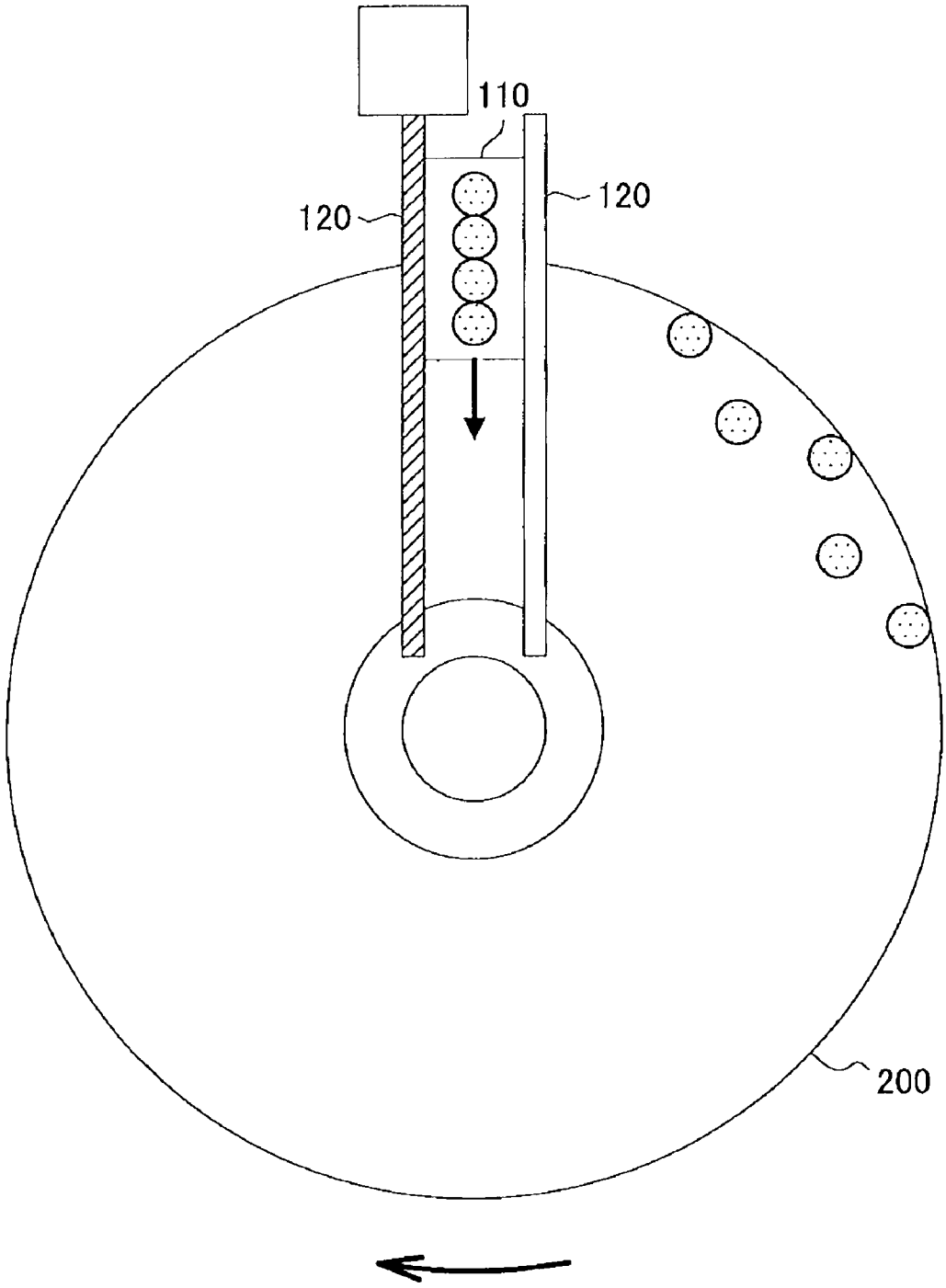
FIG. 15A is an explanatory view showing a discharge pattern of the ink droplets discharged from the inkjet head when two-path printing the pattern shown in FIG. 14.

FIGS. 15A to 15D are explanatory views showing the discharge pattern of the ink droplets discharged from the inkjet head 110 when two-path printing the pattern shown in FIG. 14. First, as shown in FIG. 15A, the discharge of ink droplets to the outermost peripheral part of the non-recording surface 230 is performed by two ink droplet discharge nozzles of the inkjet head 110.

Figure 15B:
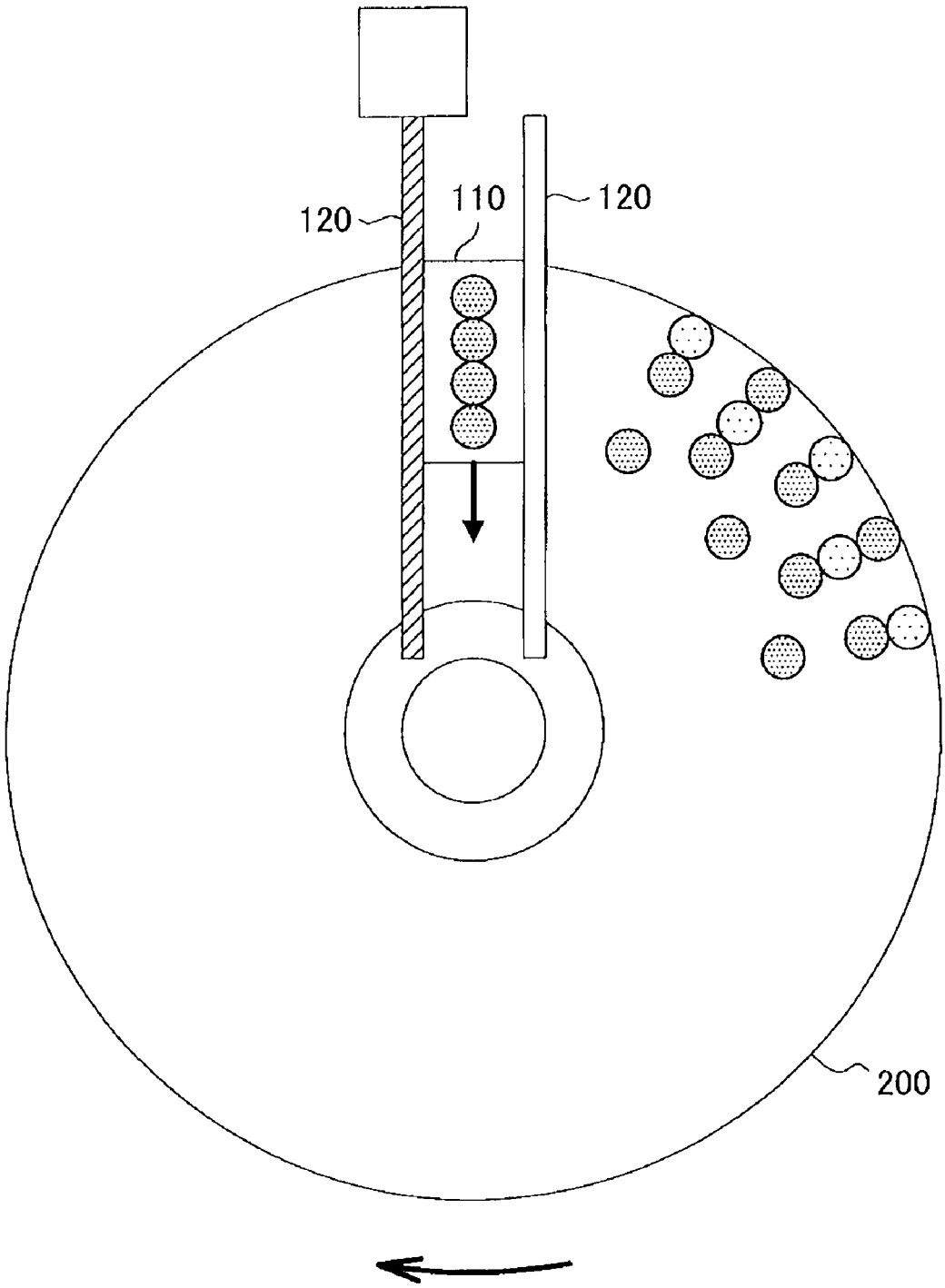
FIG. 15B is an explanatory view showing the discharge pattern of the ink droplets discharged from the inkjet head when two-path printing the pattern shown in FIG. 14.
Figure 15C:
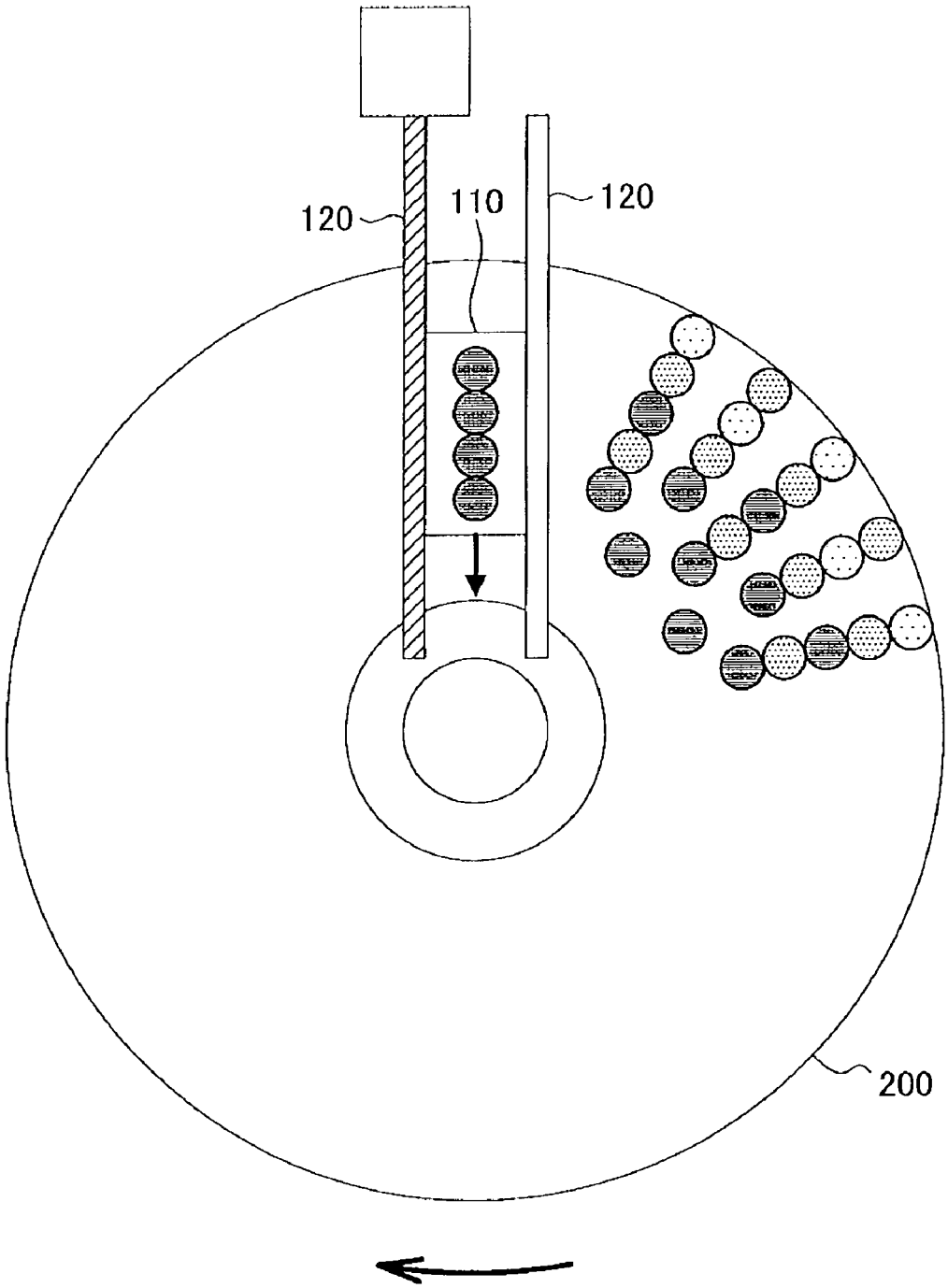
FIG. 15C is an explanatory view showing the discharge pattern of the ink droplets discharged from the inkjet head when two-path printing the pattern shown in FIG. 14.
Figure 15D:
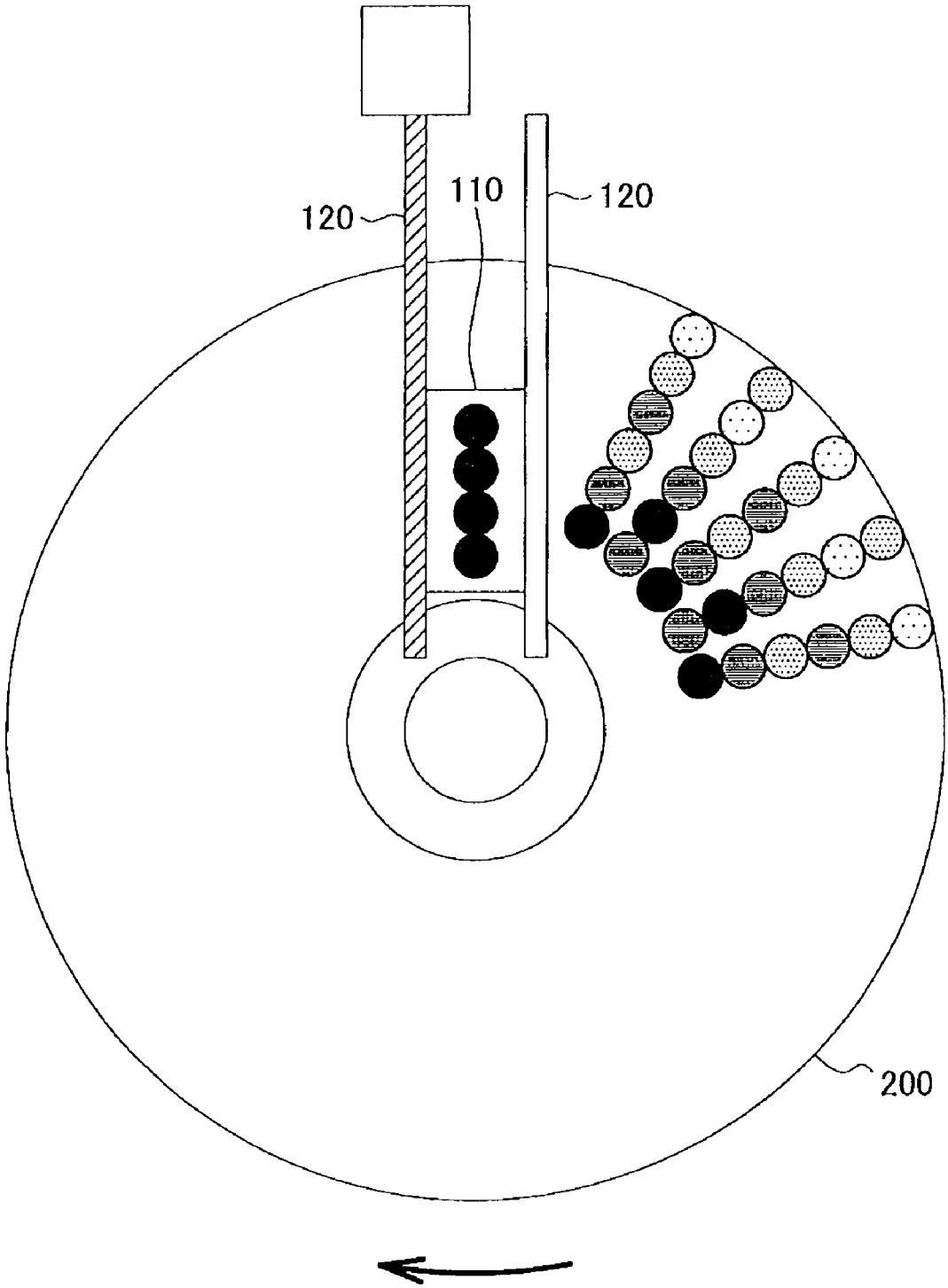
FIG. 15D is an explanatory view showing the discharge pattern of the ink droplets discharged from the inkjet head when two-path printing the pattern shown in FIG. 14.

Thereafter, as sequentially shown in FIGS. 15B, 15C, and 15D, the discharge of ink droplets from the inkjet head 110 is performed on the non-recording surface 230 while moving the inkjet head 110 in the radial direction of the optical disc 200 towards the center of the optical disc 200. In this case, the inkjet head 110 performs printing on the non-recording surface 230 by repeating the movement of a distance corresponding to the width of ½ of the number of ink droplet discharge nozzles.

The printing quality enhances by performing the multi-path printing by two-paths. However, overhang occurs at a length corresponding to the width of ½ of the number of ink droplet discharge nozzles when printing the innermost peripheral part of the non-recording surface 230 (see FIG. 15D). Interference with the chucking portion 138 occurs by such overhang.

Another pattern is shown. FIGS. 16A to 16C and FIGS. 17A to 17D are explanatory views schematically showing printing on the non-recording surface 230 of the optical disc 200 using the inkjet head 110. A case of printing through the multi-path printing by four-paths will be described.

For the sake of convenience of the explanation, the number of ink droplet discharge nozzles of the inkjet head 110 is eight, and the total number of dots in the radial direction of the non-recording surface 230 is sixteen dots. In FIGS. 16A to 16C and FIGS. 17A to 17D, only eight dots on the inner side of the sixteen dots in the radial direction are shown. For the sake of convenience of the explanation, the discharge pattern of the ink will be described by a biaxial orthogonal coordinate system in FIGS. 16A to 16C and FIGS. 17A to 17D. The numbers shown in FIGS. 16A to 16C and FIGS. 17A to 17D indicate the number of printing on the non-recording surface 230 when the printing on the outermost peripheral part is the first printing (printing of first path).

Figure 16A:
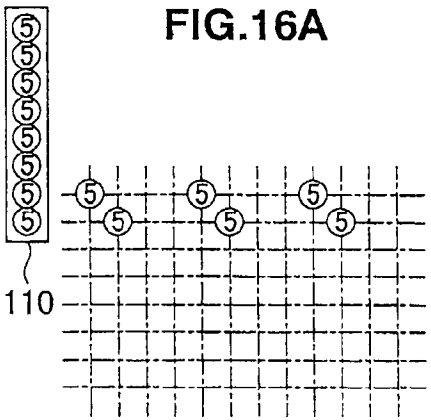
FIG. 16A is an explanatory view schematically showing printing using the inkjet head 110 with respect to the non-recording surface 230 of the optical disc 200.
Figure 16B:
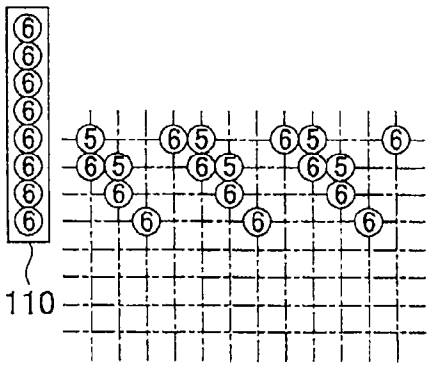
BACKGROUND ART FIG.16B
FIG. 16B is an explanatory view schematically showing printing using the inkjet head 110 with respect to the non-recording surface 230 of the optical disc 200.
Figure 16C:
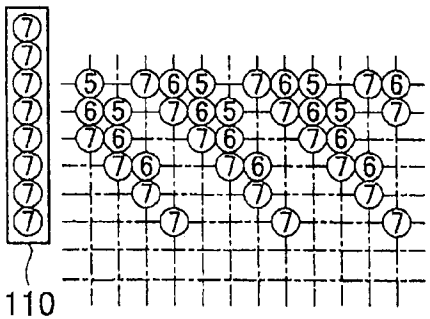
BACKGROUND ART FIG.16C
FIG. 16C is an explanatory view schematically showing printing using the inkjet head 110 with respect to the non-recording surface 230 of the optical disc 200.

FIG. 16A shows the printing pattern of the fifth path, FIG. 16B shows the printing pattern of the sixth path, and FIG. 16C shows the printing pattern of the seventh path. Therefore, when the multi-path printing is performed, the printing quality can be enhanced by dropping ink droplets to the same radius position from different ink droplet discharge nozzles.

Figure 17A:
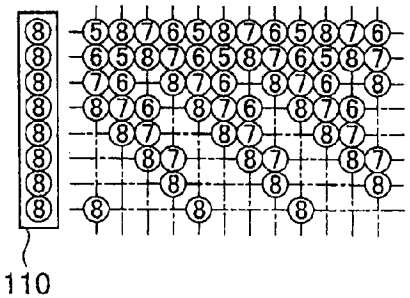
BACKGROUND ART FIG.17A
FIG. 17A is an explanatory view schematically showing printing using the inkjet head 110 with respect to the non-recording surface 230 of the optical disc 200.
Figure 17B:
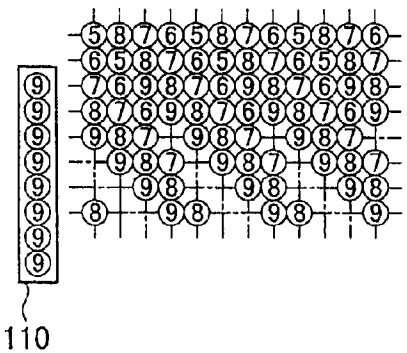
BACKGROUND ART FIG.17B
FIG. 17B is an explanatory view schematically showing printing using the inkjet head 110 with respect to the non-recording surface 230 of the optical disc 200.
Figure 17C:
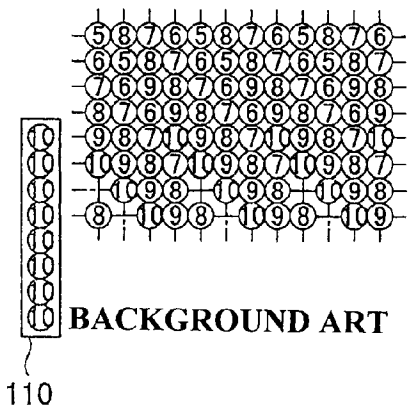
FIG. 17C is an explanatory view schematically showing printing using the inkjet head 110 with respect to the non-recording surface 230 of the optical disc 200.
Figure 17D:
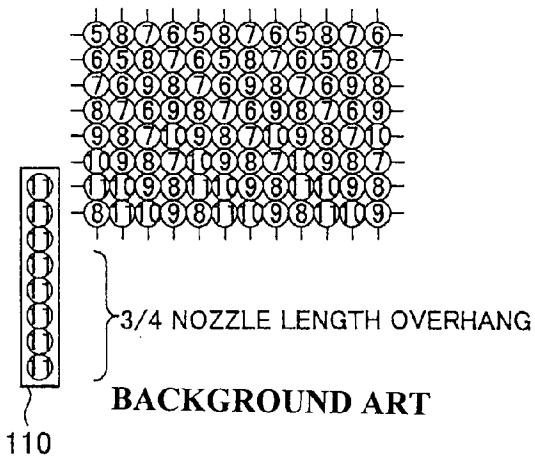
FIG. 17D is an explanatory view schematically showing printing using the inkjet head 110 with respect to the non-recording surface 230 of the optical disc 200.

FIG. 17A shows the printing pattern of the eighth path, FIG. 17B shows the printing pattern of the ninth path, FIG. 17C shows the printing pattern of the tenth path, and FIG. 17D shows the printing pattern of the eleventh path.

However, as shown in FIG. 17D, overhang occurs at the length corresponding to the width of ¾ of the number of ink droplet discharge nozzles when printing the innermost peripheral part of the non-recording surface 230. Interference with the chucking portion 138 occurs by such overhang.

Generally, the number of printings (number of multi-path scans) when printing the non-recording surface by the multi-path printing is, (total number of dots in radial direction)/(number of nozzles)×(number of multi-paths)+(number of multi-paths)−1

For instance, if the total number of dots in the radial direction is sixteen dots, the number of multi-paths is four, and the number of nozzles is eight, the number of multi-path scans is eleven.

Therefore, according to the multi-path printing in the related art, overhang of the inkjet head occurs when printing the innermost peripheral part of the non-recording surface of the recording medium, and interference with the chucking portion 138 occurs by the overhang of the inkjet head. According to the present invention, in a case of printing by the multi-path printing, printing is performed by changing the printing pattern when printing the innermost peripheral part of the non-recording surface of the recording medium. The inkjet head is prevented from causing overhang by performing printing by changing the printing pattern, so that interference with the chucking portion 138 does not occur. The printing method using the optical disc device 100 according to one embodiment of the present invention will be described in detail below.

Figure 5:
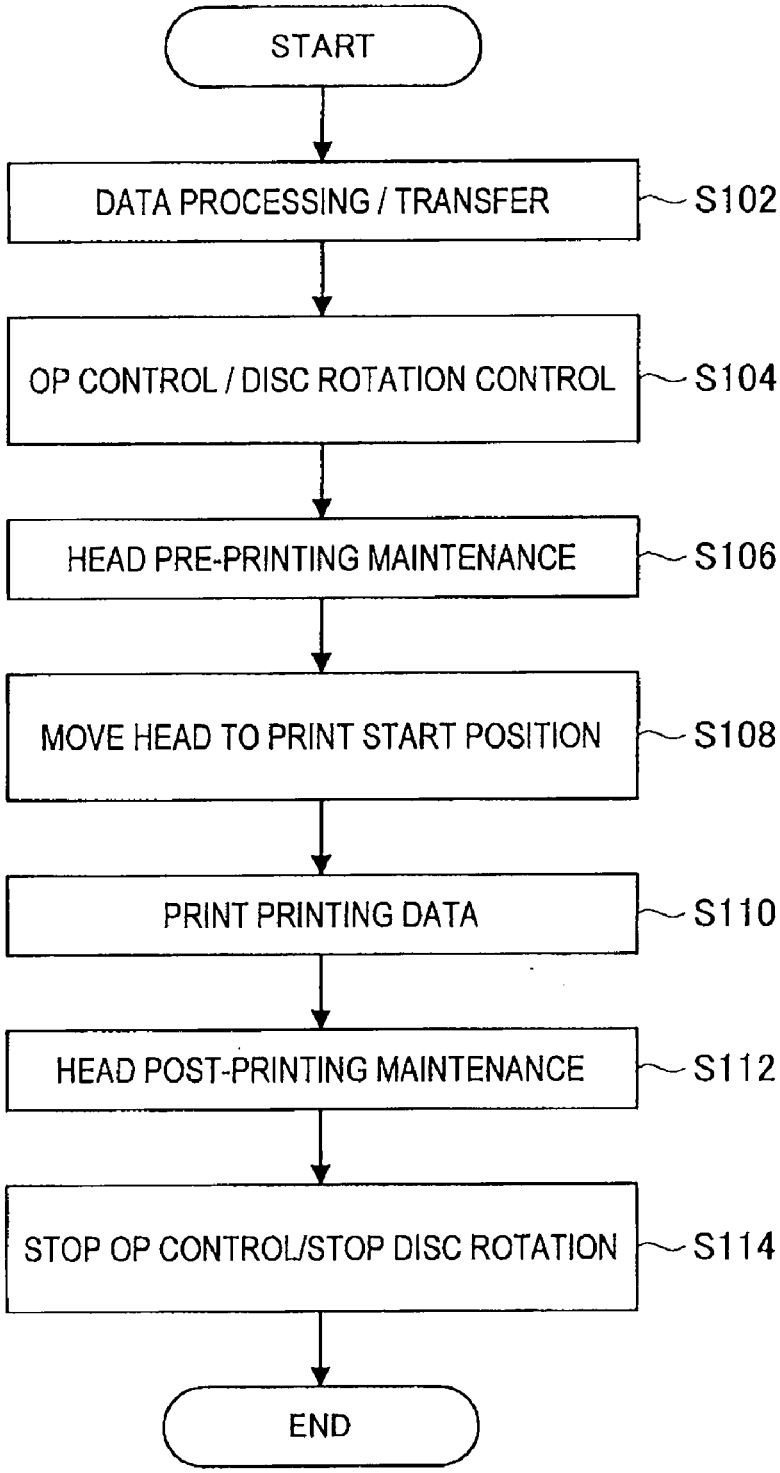
FIG. 5 is a flowchart describing a printing method using the optical disc device 100 according to one embodiment of the present invention.
Figure 6:
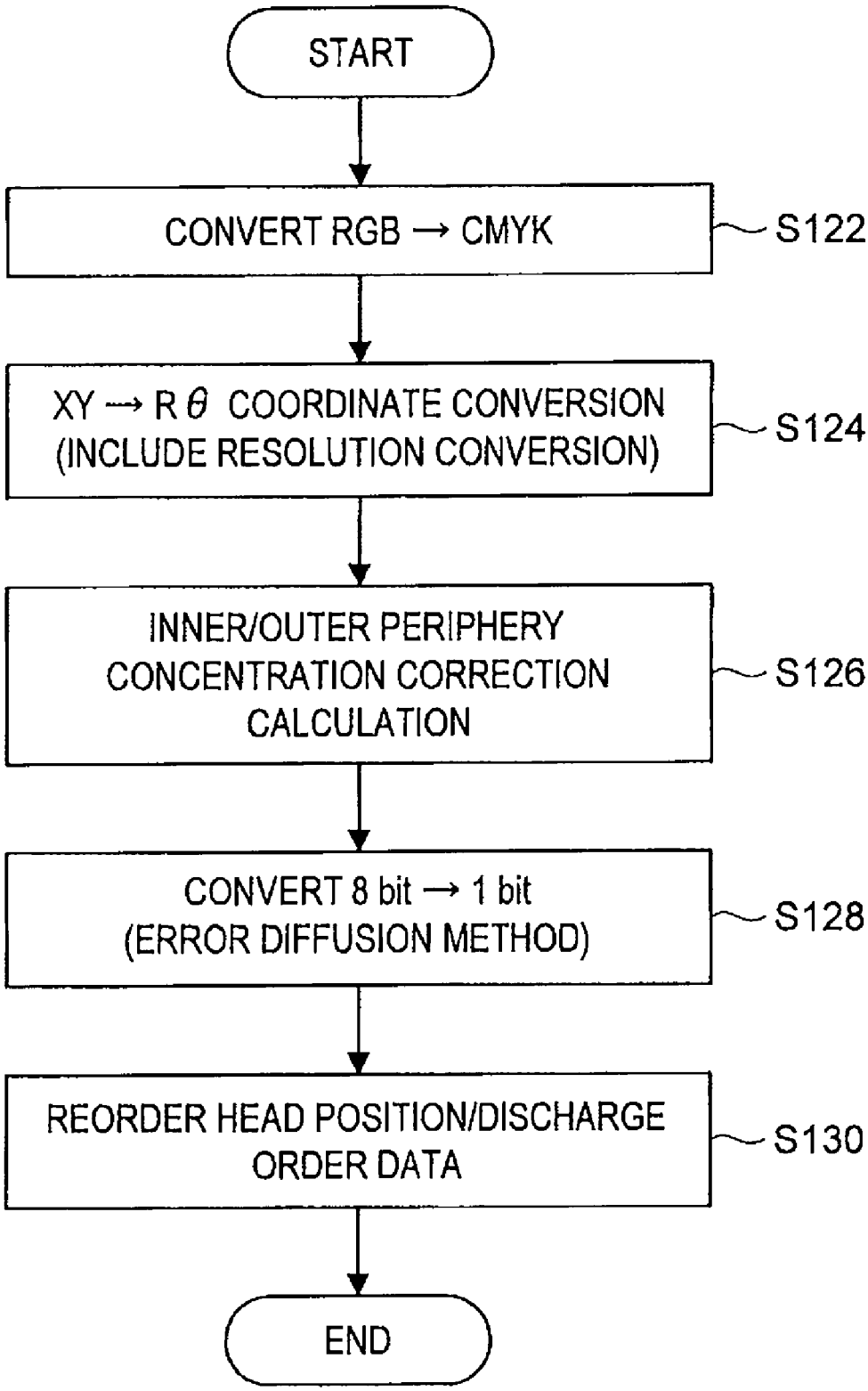
FIG. 6 is a flowchart describing the printing method using the optical disc device 100 according to one embodiment of the present invention.

FIGS. 5 and 6 are flowcharts describing the printing method using the optical disc device 100 according to one embodiment of the present invention. The printing method using the optical disc device 100 according to one embodiment of the present invention will be described below using FIGS. 5 and 6.

The outline of the printing method on the non-recording surface 230 of the optical disc 200 using the optical disc device 100 according to one embodiment of the present invention will be described first using FIG. 5. In order to print on the non-recording surface 230 using the optical disc device 100, the printing data is first processed to generate ink discharge data in the print control unit 170, and the ink discharge data is transferred to the ink discharge drive circuit 174 (step S102).

The method described in, for example, Japanese Patent Application Laid-Open No. 2008-27535 may be used in the generation of the ink discharge data by the print control unit 170, but one example of a generating method of the ink discharge data by the print control unit 170 will be described here with reference to the drawings.

FIG. 6 is a flowchart describing one example of the generating method of the ink discharge data by the print control unit 170 of the optical disc device 100 according to one embodiment of the present invention. One example of the generating method of the ink discharge data by the print control unit 170 will be described below using FIG. 6.

In order to generate the ink discharge data, the image data expressed with a tone value of each color of R (red), G (green), and B (blue) is converted to CMYK data expressed by dot (pixel) distribution of each color of C (cyan), M (magenta), Y (yellow), and K (black) (step S122). Each dot expressing the CMYK data has a respective tone value based on the image data before conversion. The tone value takes a value of between 0 and 255 (eight bits) in the present embodiment. It should be recognized that the range of the tone value is not limited to such example.

After the conversion to the CMYK data is completed, the data of each color of the CMYK data expressed in the biaxial orthogonal coordinate is then converted to polar coordinate (Rθ) data (step S124). In the conversion from the biaxial orthogonal coordinate to the polar coordinate, the resolution is converted through a general method of nearest neighbor method, bilinear method, bicubic method, or the like, and converted to the polar coordinate data corresponding to the size of the non-recording surface 230 of the optical disc 200.

After the conversion of the data of each color of the CMYK data to the polar coordinate data is completed, inner/outer periphery concentration correction calculation of the non-recording surface 230 of the optical disc 200 is performed (step S126). The inner/outer periphery concentration correction calculation is a calculation for weighting the tone value of each dot of the polar coordinate data. Specifically, the inner/outer periphery concentration correction calculation is a calculation of reducing the tone value of the dot towards the inner periphery side of the polar coordinate data.

The weight by the inner/outer periphery concentration correction may be calculated by the ratio of the number of dots per unit area having a dot to be weighted as a center and the number of dots per unit area having a dot positioned on the outermost periphery of the polar coordinate data as a center. In the present embodiment, the weight is approximately calculated by the ratio of the radius value of the dot to be weighted and the radius value of the dot positioned on the outermost periphery of the polar coordinate data.

Assuming the radius value of the dot $d_i$ to be weighted is $r_i$, and the radius value of the dot $d_N$ positioned on the outermost periphery of the polar coordinate data is $r_N$, the weight $W(d_i)$ with respect to the dot $d_i$ is calculated by $W(d_i)=r_i/r_N$. For instance, if the radius value $r_i$ of the dot $d_i$ is $r_i$=30 mm, and the radius value $r_N$ of the dot $d_N$ is $r_N$=60 mm, the weight $W(d_i)$ is 0.5.

The weight with respect to the dots positioned on the same radius value is set to the same weight by approximately calculating the weight W with respect to each dot. Thus, the number of weights to be stored in the memory (not shown) then can be reduced, the capacity of the memory can be reduced, and the power consumption of the memory can be suppressed.

The inner/outer periphery concentration correction calculation may use the method disclosed in Japanese Patent Application Laid-Open No. 2008-27534 other than the above-described method. Japanese Patent Application Laid-Open No. 2008-27534 discloses a method of setting a dropping position (i.e., position at where whether to drop or not is determined) of the ink droplets with respect to the printing surface of the rotatably driven recording medium so as to be at equal interval in the peripheral direction of the printing object, and performing printing of visual information at substantially uniform printing concentration in the printing surface.

After the inner/outer periphery concentration correction calculation is completed, a binarization process of converting the data of each color of the CMYK data after the correction to the data of one bit is performed to generate the ink discharge data (step S128). In the present embodiment, the binarization process is performed by the error diffusion method. The error diffusion method includes Floyd-Steinberg type, Jarvis, Judice & Ninke type, and the like.

The ink discharge data generated in step S128 is data representing whether or not to drop the ink droplets to the position to which each dot corresponds in the non-recording surface 230 of the optical disc 200. In the present embodiment, the tone value of each dot of the binarized ink discharge data is expressed with 0 and 1 (one bit). The ink droplets are dropped to the corresponding dot on the non-recording surface 230 of the optical disc 200 with respect to the dot which tone value is "1", and the ink droplets are not dropped to the dot which tone value is "0".

After the generation of the ink discharge data is completed in step S128, the ink discharge data is sorted according to the number of ink droplet discharge nozzles 152 lined in the radial direction of the optical disc 200, discharge frequency from the ink droplet discharge nozzles 152, and the rotation speed of the optical disc 200 (step S130). The sorting of the ink discharge data includes dividing the ink discharge data according to the number of ink droplet discharge nozzles 152 and changing the ink discharge order in performing decimated printing according to the rotation speed of the optical disc 200.

The amount of overhang of the inkjet head 110 is reduced by changing the printing pattern at the innermost peripheral part of the non-recording surface 230 of the optical disc 200 through sorting of the ink discharge data in step S130. The interference between the inkjet head 110 and the chucking portion 138 can be prevented by reducing the amount of overhang of the inkjet head 110.

A variant of the printing pattern using the optical disc device 100 according to one embodiment of the present invention will be described below. In the explanatory diagram of the ink discharge pattern used in the description of the subsequent variants, the total number of dots in the radial direction of the non-recording surface 230 is sixteen dots, and only eight dots on the inner side are shown in each figure unless otherwise stated. The number of ink droplet discharge nozzles of the inkjet head 110 is eight.

(Variant 1)

Figures 7A, 7B, 7C, 7D, 7E:
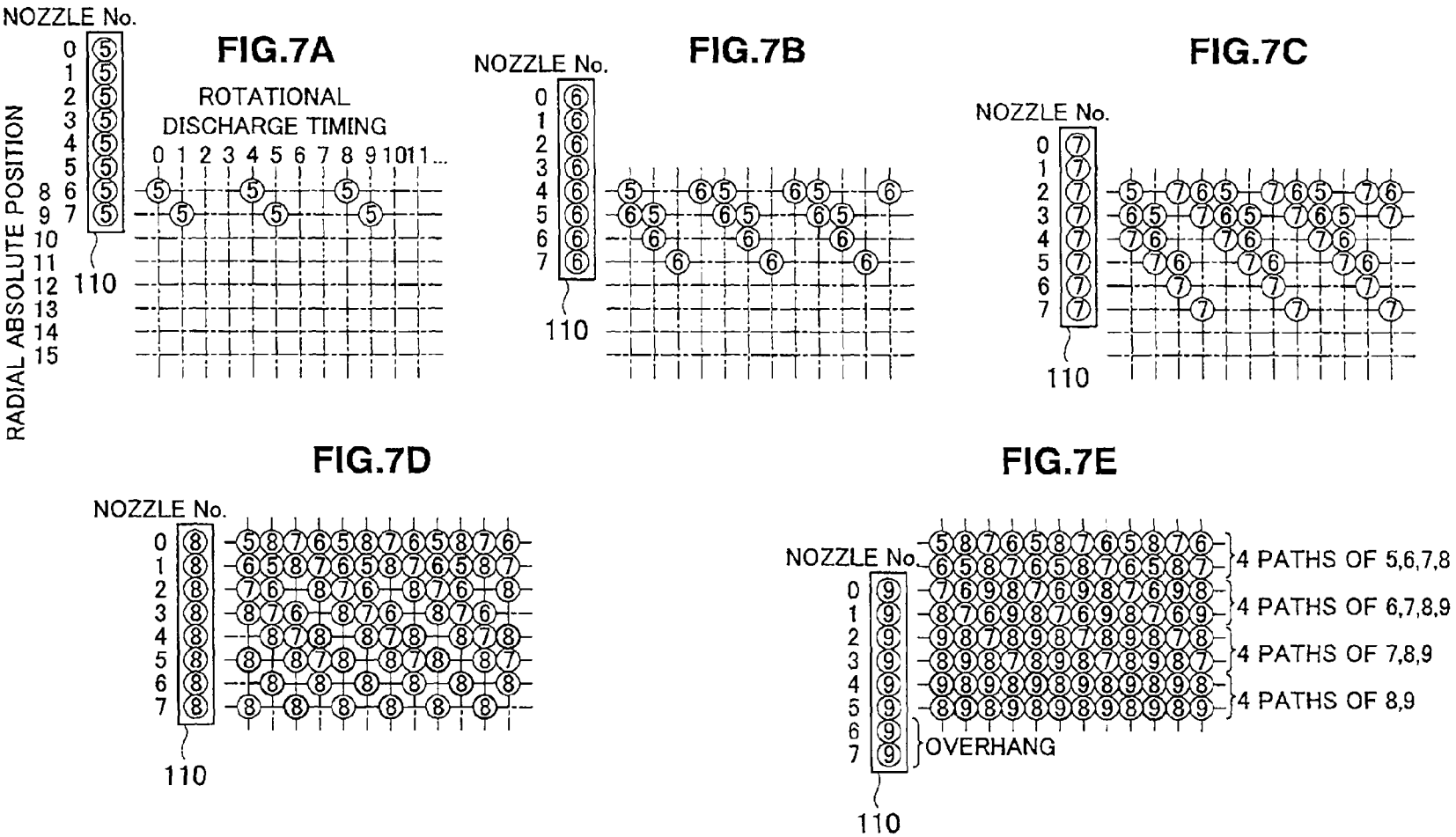
FIG. 7A is an explanatory diagram describing a first variant of a printing pattern in the printing method according to one embodiment of the present invention.
FIG. 7B is an explanatory diagram describing the first variant of the printing pattern in the printing method according to one embodiment of the present invention.
FIG. 7C is an explanatory diagram describing the first variant of the printing pattern in the printing method according to one embodiment of the present invention.
FIG. 7D is an explanatory diagram describing the first variant of the printing pattern in the printing method according to one embodiment of the present invention.
FIG. 7E is an explanatory diagram describing the first variant of the printing pattern in the printing method according to one embodiment of the present invention.

FIGS. 7A to 7E are explanatory diagrams describing a first variant of the printing pattern in the printing method according to one embodiment of the present invention, and FIGS. 8A to 8C are explanatory diagrams showing the ink discharge data for realizing the printing pattern shown in FIG. 7.

FIGS. 7A to 7E show a case in which the printing pattern of four dots on the inner side is changed with respect to the multi-path printing of four-paths shown in FIGS. 16 and 17. FIGS. 7A to 7C show the printing pattern of when the multi-path printing of four-paths is performed, similar to FIGS. 16A to 16C. FIGS. 7D and 7E show a case in which the printing pattern with respect to the four dots on the inner side is changed. In FIG. 7A, the rotational direction discharge timing is shown on the horizontal direction and the radial absolute position is shown on the vertical direction, where the numbers denoted near the inkjet head 110 represents the nozzle No. of the ink droplet discharge nozzles 152.

In other words, as shown in FIG. 7D, the ink droplets are dropped even to the dot (relevant dot is shown in heavy line in the figure) not printed in the printing of the eighth path of the related art shown in FIG. 17A in time of the printing of the eighth path. Then, as shown in FIG. 7E, the ink droplets are dropped even to the dot (relevant dot is shown in heavy line in the figure) not printed in the printing of the ninth path of the related art shown in FIG. 17B in time of the printing of the ninth path.

Therefore, the amount of overhang of the inkjet head 110 can be suppressed to the length corresponding to the width of ¼ of the number of ink droplet discharge nozzles by changing the printing pattern at the innermost peripheral portion of the non-recording surface 230 with respect to the printing pattern at other portions. Therefore, interference between the inkjet head 110 and the chucking portion 138 can be prevented by changing the printing pattern.

FIGS. 8A to 8C are explanatory views showing the ink discharge data for realizing the printing pattern shown in FIGS. 7A to 7E. FIG. 8A shows the rotational discharge timing on the horizontal axis, and the radial absolute position on the vertical axis, where the numbers on the horizontal axis and the vertical axis correspond to the numbers shown in FIG. 7A.

FIG. 8B shows the ink discharge data in time of the printing of the eighth path according to the present variant shown in FIG. 7D, and FIG. 8C shows the ink discharge data in time of the printing of the ninth path according to the present variant shown in FIG. 7E. In FIGS. 8B and 8C, the rotational discharge timing is shown on the horizontal axis, and the nozzle No. is shown on the vertical axis. In FIGS. 8A to 8C, "0" indicates the dot to which the ink is not discharged, and "1" indicates the dot to which the ink is discharged.

The printing pattern as shown in FIG. 7 is realized by sorting the ink discharge data as shown in FIGS. 8B and 8C in step S130. As a result, the amount of overhang of the inkjet head 110 can be suppressed to the length corresponding to the width of ¼ of the number of ink droplet discharge nozzles.

(Variant 2)

Figure 9A:
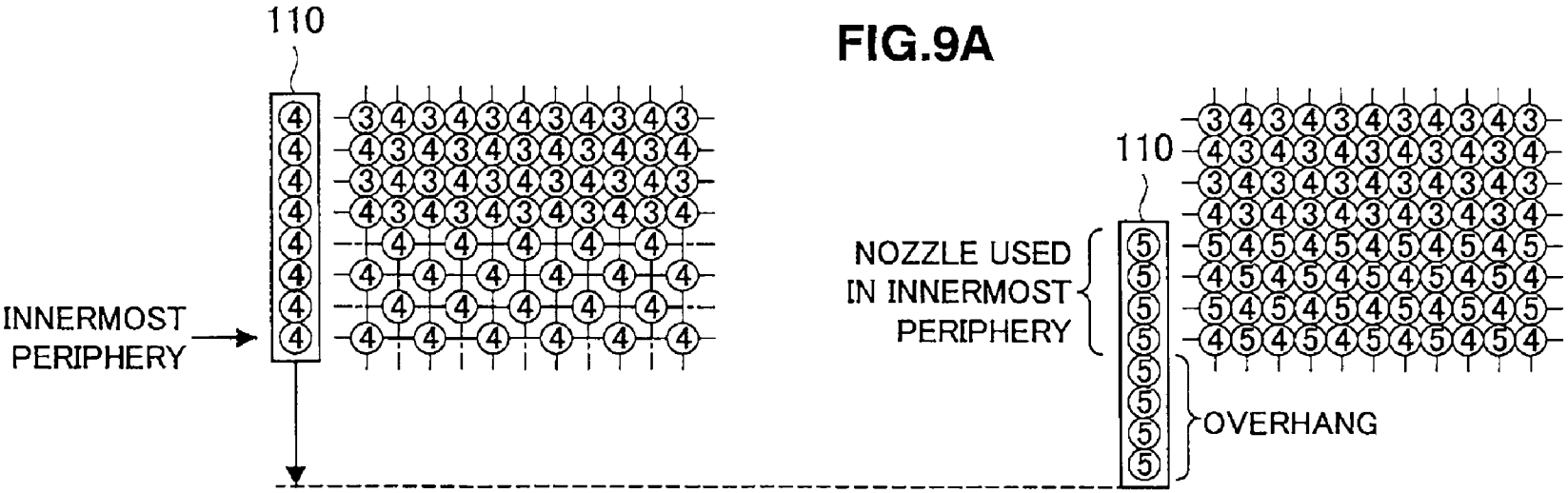
FIG. 9A is an explanatory view describing a second variant of a printing pattern in the printing method according to one embodiment of the present invention.
Figure 9B:
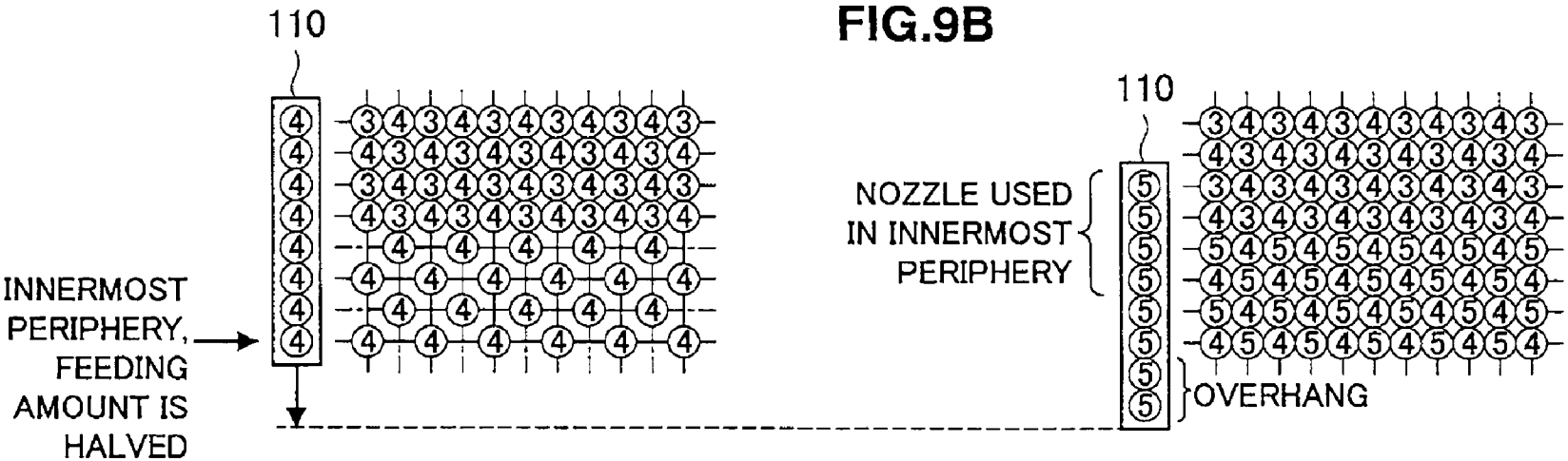
FIG. 9B is an explanatory view describing the second variant of the printing pattern in the printing method according to one embodiment of the present invention.

FIGS. 9A and 9B are explanatory views describing a second variant of the printing pattern in the printing method according to one embodiment of the present invention. FIGS. 9A and 9B show the printing pattern in time of multi-path printing by two-paths.

FIG. 9A shows the printing pattern in time of the multi-path printing by two-paths of the related art. As shown in FIG. 9A, in the related art, when the printing of the fourth path is completed, the inkjet head 110 is moved by the distance corresponding to four ink droplet discharge nozzles 152. The printing of the fifth path, which is the printing of the innermost periphery, is then executed using the ink droplet discharge nozzles 152 of nozzle Nos. 0 to 3. Therefore, in the related art, overhang worth the length corresponding to the width of ½ of the number of ink droplet discharge nozzles occurred, as shown in FIG. 9A.

In the present variant, the feeding amount (movement amount) of the inkjet head 110 is halved when performing the printing of the fifth path, as shown in FIG. 9B. That is, in step S130, the ink discharge data is sorted so as to realize the printing as shown in FIG. 9B. As shown in FIG. 9B, the amount of overhang of the inkjet head 110 can be suppressed to the length corresponding to the width of ¼ of the number of ink droplet discharge nozzles by halving the movement amount of the inkjet head 110.

Therefore, as shown in FIGS. 9A and 9B, the interference between the inkjet head 110 and the chucking portion 138 is prevented by printing with the movement amount of the inkjet head 110 reduced when performing printing of the innermost periphery. It should be apparent that although the movement amount of the inkjet head 110 is halved in the example shown in FIG. 9, the present invention is not limited to such example. The movement amount of the inkjet head 110 may be the width of one ink droplet discharge nozzle 152, but when moved by the width of one ink droplet discharge nozzles 152, a line where printing failure occurs inevitably lines up if the nozzle from which the ink droplets are not discharged exists. Therefore, the movement amount of the inkjet head 110 is desirably greater than or equal to the width of at least two ink droplet discharge nozzles 152.

(Variant 3)

Figures 10A, 10B, 10C:
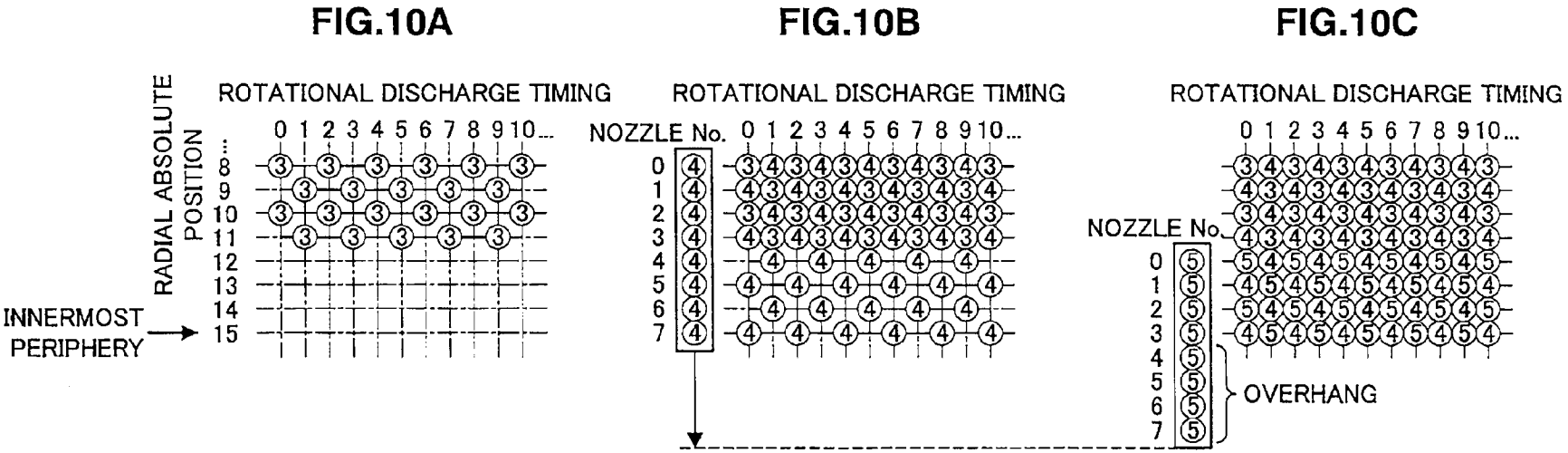
FIG. 10A is an explanatory view showing a printing pattern in time of multi-path printing by two-paths of the related art.
FIG. 10B is an explanatory view showing the printing pattern in time of multi-path printing by two-paths of the related art.
FIG. 10C is an explanatory view showing the printing pattern in time of multi-path printing by two-paths of the related art.

FIGS. 10A to 13 are explanatory views describing a third variant of the printing pattern in the printing method according to one embodiment of the present invention. FIGS. 10A to 10C are explanatory views showing the printing pattern in time of multi-path printing by two-paths of the related art, and FIGS. 11A to 11C are explanatory views showing the ink discharge data in time of the multi-path printing by two-paths of the related art shown in FIGS. 10A and 10B. FIGS. 12A and 12B are explanatory views showing the printing pattern according to the present variant, and FIG. 13 is an explanatory view showing the ink discharge data for realizing the printing pattern according to the present variant shown in FIGS. 12A and 12B.

The printing pattern in time of the multi-path printing by two-paths of the related art will be first described using FIGS. 10A to 10C and FIGS. 11A to 11C. FIG. 10A shows the discharge state of the ink to the non-recording surface 230 at the time point the printing of the third path is completed. FIG. 10B shows the printing pattern of the fourth path in the multi-path printing by two-paths, and FIG. 10C is an explanatory view showing the printing pattern of the fifth path in the multi-path printing by two-paths.

FIG. 11A shows the rotational discharge timing on the horizontal axis and the radial absolute value on the vertical axis, where the numbers on the horizontal axis and the vertical axis correspond to the numbers shown in FIG. 10.

FIG. 11B shows the ink discharge data in time of the printing of the fourth path shown in FIG. 10B, and FIG. 11C shows the ink discharge data in time of the printing of the fifth path shown in FIG. 10C. In FIGS. 11B and 11C, the rotational discharge timing is shown on the horizontal axis, and the nozzle No. is shown on the vertical axis. In FIGS. 11A to 11C, "0" indicates the dot to which the ink is not discharged, and "1" indicates the dot to which the ink is discharged.

Figure 12A:
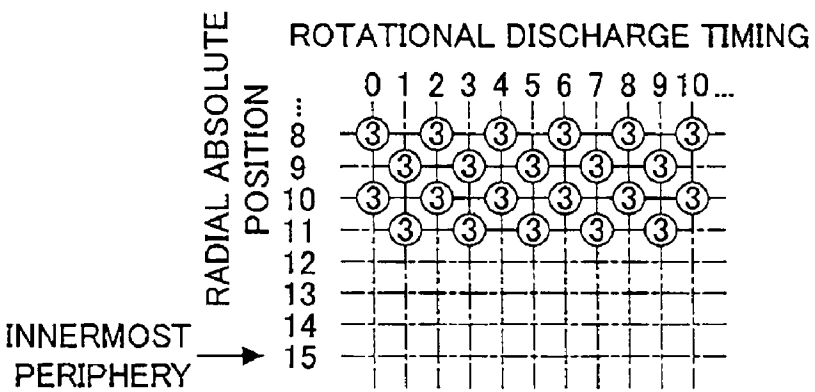
FIG. 12A is an explanatory view describing a third variant of a printing pattern in the printing method according to one embodiment of the present invention.
Figure 12B:
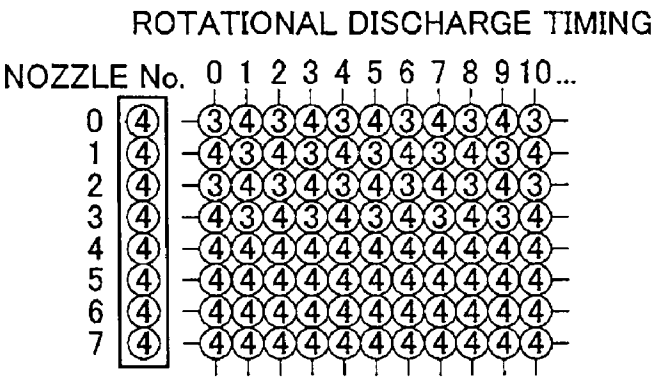
FIG. 12B is an explanatory view describing the third variant of the printing pattern in the printing method according to one embodiment of the present invention.

When printing the data as shown in FIGS. 11A to 11C, overhang of the length corresponding to the width of ½ of the number of ink droplet discharge nozzles occurred when executing the printing of the fifth path in the related art, as shown in FIG. 10C. Thus, in the present variant, the multi-path printing by two-paths is not performed on the four dots from the dot on the innermost periphery, and all the dots are printed in one printing operation when executing the printing of the fourth path, as shown in FIGS. 12A and 12B.

Therefore, printing can be performed without causing the overhang of the inkjet head 110 by printing all the dots to be printed in one printing operation instead of the multi-path printing when printing the innermost peripheral part.

Three variants of the printing pattern using the optical disc device 100 according to one embodiment of the present invention have been illustrated and described. It should be recognized that the printing pattern in the embodiment of the present invention is not limited to such examples.

Returning to FIG. 5, the description on the printing method using the optical disc device 100 according to one embodiment of the present invention will be continued. After the generation of the ink discharge data in the print control unit 170 and the transfer of the ink discharge data to the ink discharge drive circuit 174 are completed in step S102, the rotation of the optical disc 200 and the drive of the optical pickup 140 (Optical Pickup; OP) are controlled (step S104). Thereafter, pre-printing maintenance is executed on the inkjet head 110 (step S106). The pre-printing maintenance on the inkjet head 110 includes removal of ink remaining on the surface of the ink droplet discharge nozzles 152 by brushing away the nozzle surface 150 using the blade 124, or the like.

After the pre-printing maintenance on the inkjet head 110 is completed, the inkjet head 110 is moved to the print start position (step S108). After the movement of the inkjet head 110 to the print start position in step S108 is completed, printing is started on the non-recording surface 230 of the optical disc 200 based on the ink discharge data in which sorting is performed in step S130 (step S110).

After the printing on the non-recording surface 230 of the optical disc 200 based on the ink discharge data is completed, the post-printing maintenance is executed on the inkjet head 110 (step S112). The post-printing maintenance on the inkjet head 110 includes removal of ink remaining on the surface of the ink droplet discharge nozzles 152 by brushing away the nozzle surface 150 using the blade 124, or the like.

After the post-printing maintenance on the inkjet head 110 is completed, the rotation of the optical disc 200 and the drive of the optical pickup 140 are stopped (step S114), and the printing on the non-recording surface 230 of the optical disc 200 is completed.

The printing method using the optical disc device 100 according to one embodiment of the present invention has been described above using FIGS. 5 and 6. As described above, according to the optical disc device 100 and the printing method using the optical disc device 100 of one embodiment of the present invention, when performing printing on the non-recording surface 230 of the optical disc 200 by the multi-path printing, printing is performed by changing the printing pattern when printing the innermost peripheral part. The printing can be performed with the amount of overhang of the inkjet head 110 reduced, and printing can be performed so as not to cause overhang by performing printing by changing the printing pattern when printing the innermost peripheral part.

The printing method using the optical disc device 100 according to one embodiment of the present invention described above may be carried out by having the central control unit 162 sequentially read out the computer program stored in the optical disc device 100. For instance, the print control unit 170 and the ink discharge drive circuit 174 may be controlled, and the printing may be executed on the non-recording surface 230 of the optical disc 200 by executing the relevant program.

The present application contains subject matter related to that disclosed in Japanese Priority Patent Application JP 2008-98338 filed in the Japan Patent Office on Apr. 4, 2008, the entire contents of which hereby incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A printing apparatus comprising:

a printing unit for printing visual information on a non-recording surface of a recording medium, which is detachably attached and rotatably driven, by discharging ink droplets; and a control unit for controlling movement of the printing unit in a radial direction of the rotatably driven recording medium, and controlling a discharge timing of the ink droplets discharged from the printing unit, wherein the printing unit includes a plurality of ink droplet discharge nozzles, and prints the visual information by multi-path printing of completing printing on a circumferential path along a same radius position of the non-recording surface by discharging ink from different ink discharge nozzles on the circumferential path, and the control unit controls the printing unit so as to print with a first multi-path printing pattern having a first number of paths and a second multi-path printing pattern having a second number of paths different from the first number of paths, the first multi-path printing pattern used when printing on other locations of the non-recording surface and the second multi-path printing pattern used when printing on an innermost periphery region smaller than a length of a plurality of ink droplet discharge nozzles at an inner peripheral part of a printable region of the non-recording surface.

2. The printing apparatus according to claim 1, wherein the control unit controls the printing unit so as to print with a number of paths of the multi-path printing reduced compared to other locations of the non-recording surface when multi-path printing the innermost peripheral region of the non-recording surface.

3. The printing apparatus according to claim 1, wherein the control unit controls the printing unit so that a movement amount of the printing unit is smaller than a movement amount of other locations when multi-path printing the innermost peripheral region of the non-recording surface.

4. The printing apparatus according to claim 1, wherein the control unit controls the printing unit so as to print on the same radius position of the non-recording surface by discharging ink from the same ink discharge nozzle with respect to the innermost peripheral region of the non-recording surface.

5. The printing apparatus according to claim 1, wherein a first number of the ink discharge nozzles is used in the first multi-path printing pattern, and a second number of the ink discharge nozzles different from the first number of the ink discharge nozzles is used in the second multipath printing pattern.

6. A printing method comprising:

generating printing data of visual information to print on a non-recording surface of a recording medium, which is detachably attached and rotatably driven;

printing the visual information by multi-path printing of completing printing on a circumferential path along a same radius position of the non-recording surface by discharging ink from different ink discharge nozzles on the circumferential path by a printing unit including a plurality of ink droplet discharge nozzles; and controlling the printing unit to print with a first multi-path printing pattern having a first number of paths and a second multi-path printing pattern having a second number of paths different from the first number of paths, the first multi-path printing pattern used when printing on other locations of the non-recording surface and the second multi-path printing pattern used when printing on an innermost peripheral region smaller than a length of the plurality of ink droplet discharge nozzles at an inner peripheral part of a printable region of the non-recording surface.

7. A computer-readable storage medium storing thereon a program for causing a computer to execute the steps of:

generating printing data of visual information to print on a non-recording surface of a recording medium, which is detachably attached and rotatably driven;

printing the visual information by multi-path printing of completing printing on a circumferential path drawn at a same radius position of the non-recording surface by discharging ink from different ink discharge nozzles by a printing unit including a plurality of ink droplet discharge nozzles; and controlling the printing unit to print with a first multi-path printing pattern having a first number of paths and a second multi-path printing pattern having a second number of paths different from the first number of paths, the first printing pattern used when printing on other locations of the non-recording surface and the second printing pattern used when printing on an innermost peripheral region smaller than a length of the plurality of ink droplet discharge nozzles at an inner peripheral part of a printable region of the non-recording surface.

* * * * *